US008141280B2

(12) United States Patent
Doss

(10) Patent No.: US 8,141,280 B2
(45) Date of Patent: Mar. 27, 2012

(54) DATE CYCLING STORAGE CALENDAR

(76) Inventor: Cathryne Doss, Mechanicsville, VA (US)

( * ) Notice: Subject to any disclaimer, the term of this patent is extended or adjusted under 35 U.S.C. 154(b) by 1878 days.

(21) Appl. No.: 10/440,981

(22) Filed: May 19, 2003

(65) Prior Publication Data

US 2003/0217487 A1 Nov. 27, 2003

Related U.S. Application Data

(63) Continuation-in-part of application No. 09/748,851, filed on Dec. 28, 2000, now Pat. No. 6,591,522.

(51) Int. Cl.
*G09D 3/02* (2006.01)

(52) U.S. Cl. ..... 40/122; 40/107

(58) Field of Classification Search ..... 40/107, 40/110, 120, 122, 124, 490, 124.2; 283/2; 312/234.4, 234, 246, 122, 245, 234.5, 119; 211/90.02, 90.04, 50, 55, 10; 206/555
See application file for complete search history.

(56) References Cited

U.S. PATENT DOCUMENTS

| | | | | | |
|---|---|---|---|---|---|
| 301,553 | A | * | 7/1884 | Bereman | 40/109 |
| 811,846 | A | | 2/1906 | Hidden | |
| 1,108,893 | A | | 9/1914 | Ellinwood | |
| 1,156,812 | A | | 10/1915 | Probert | |
| 1,158,729 | A | | 1/1926 | Gearon | |
| 2,831,278 | A | | 4/1958 | Myers | |
| 3,207,421 | A | | 9/1965 | Hunger et al. | |
| 3,466,126 | A | | 9/1969 | Sakamoto | |
| 3,824,722 | A | * | 7/1974 | Maruscak et al. | 40/585 |
| 3,911,606 | A | | 10/1975 | Hunkins | |
| 3,978,601 | A | * | 9/1976 | Catron | 40/322 |
| 3,983,649 | A | | 10/1976 | Ellis et al. | |
| 4,192,439 | A | | 3/1980 | Segal | |
| 4,321,763 | A | | 3/1982 | Soucy | |
| 4,596,082 | A | * | 6/1986 | Lane | 40/107 |
| 4,640,560 | A | | 2/1987 | Blum | |
| 4,863,386 | A | | 9/1989 | Maxey | |
| 4,975,061 | A | | 12/1990 | Avrill | |
| 5,092,062 | A | | 3/1992 | Palka | |
| 5,214,869 | A | | 6/1993 | Wilen | |
| 5,412,886 | A | | 5/1995 | Quinn | |
| 5,755,337 | A | | 5/1998 | Linn | |
| 5,797,204 | A | | 8/1998 | Paulos | |
| 5,813,539 | A | | 9/1998 | DePalma | |

FOREIGN PATENT DOCUMENTS

| | | |
|---|---|---|
| GB | 305807 | 2/1929 |

* cited by examiner

*Primary Examiner* — Joanne Silbermann
(74) *Attorney, Agent, or Firm* — Brian J. Teague

(57) ABSTRACT

A calendar comprising a backing member and a plurality of detachable storage trays is disclosed. The calendar further comprises a plurality of backing securing mechanisms, each of which is associated with a calendar position on the backing member. Each of the detachable storage trays includes a plurality of storage compartments and a tray securing mechanism. Each storage compartment has an associated calendar identifier. The tray securing mechanisms are configured for quick-release attachment to and quick-release detachment from the backing securing mechanisms associated with the calendar positions.

20 Claims, 29 Drawing Sheets

DATE CYCLING STORAGE CALENDAR

This application is a continuation-in-part of U.S. patent application Ser. No. 09/748,851 filed Dec. 28, 2000, now U.S. Pat. No. 6,591,522 entitled "Date Cycling Storage Calendar," the contents of which are incorporated herein in their entirety to the extent that it is consistent with this invention and application.

BACKGROUND OF THE INVENTION

The invention is generally related to calendars, and more particularly to calendars that are used to store reminder information and other articles for the convenience of the user.

In the modern home, calendars are commonly used to keep track of the family's daily appointments and activities. The most common form of calendar used remains the single page monthly layout format. Families use these calendars to post important reminders for birthdays, doctor's appointment, soccer practices, etc. These days, however, families are usually so busy that most monthly calendars do not have enough space in each daily spot to record all the day's activities. This necessitates a more robust calendar, capable of organizing the modern family's schedule.

SUMMARY OF THE INVENTION

In accordance with a first embodiment of the invention, a calendar comprising a backing member and a plurality of detachable storage trays is disclosed. The calendar further comprises a plurality of backing securing mechanisms, each of which is associated with a calendar position on the backing member. Each of the detachable storage trays includes a plurality of storage compartments and a tray securing mechanism. Each storage compartment has an associated calendar identifier. The tray securing mechanisms are configured for quick-release attachment to and quick-release detachment from the backing securing mechanisms associated with the calendar positions.

In accordance with a second embodiment of the invention, a calendar is disclosed. The calendar comprises a backing member, a first backing securing mechanism associated with a first calendar position on the backing member, a second backing securing mechanism associated with a second calendar position on the backing member, and a plurality of detachable storage trays. Each of the detachable storage trays includes a plurality of storage compartments each having an associated calendar identifier. The detachable storage trays also include at least one tray securing mechanism. Accordingly, a first detachable storage tray having a first tray securing mechanism is configured for quick-release attachment to and quick-release detachment from the first calendar position and the second calendar position, for example.

In accordance with a third embodiment of the invention, a method of utilizing a calendar is disclosed. The method comprises providing a calendar having a backing member, attaching a first tray securing mechanism of a first detachable tray to a first backing securing mechanism associated with a first calendar position on the backing member, the first detachable tray having a plurality of first storage compartments each having a first associated calendar identifier, attaching a second tray securing mechanism of a second detachable tray to a second backing securing mechanism associated with a second calendar position on the backing member, the second detachable tray having a plurality of second storage compartments each having a second associated calendar identifier. The method further comprises detaching the first detachable tray from the first backing securing mechanism, detaching the second detachable tray from the second backing securing mechanism, changing the first calendar identifiers associated with the first storage compartments in the first detachable tray, attaching the second detachable tray to the first backing securing mechanism in the first calendar position, and attaching the first detachable tray to a third backing securing mechanism in a third calendar position, for example.

BRIEF DESCRIPTION OF THE DRAWINGS

The present invention can be more fully understood by reading the following detailed description of the presently preferred embodiments together with the accompanying drawings, in which like reference indicators are used to designate like elements, and in which.

DETAILED DESCRIPTION OF PREFERRED EMBODIMENTS

As described above, various embodiments of a calendar, and methods for using the same, are disclosed in accordance with the invention. In general, each of the various embodiments of the inventive calendar include at least a backing member, a plurality of detachable storage trays, and a plurality of securing mechanisms, each of which is associated with a calendar position on the backing member. Each of the detachable storage trays generally includes a plurality of storage compartments and at least one tray securing mechanism. A calendar identifier is associated with each storage compartment. The tray securing mechanisms are configured for quick-release attachment to and quick-release detachment from the backing securing mechanisms associated with the calendar positions.

Figure 1:
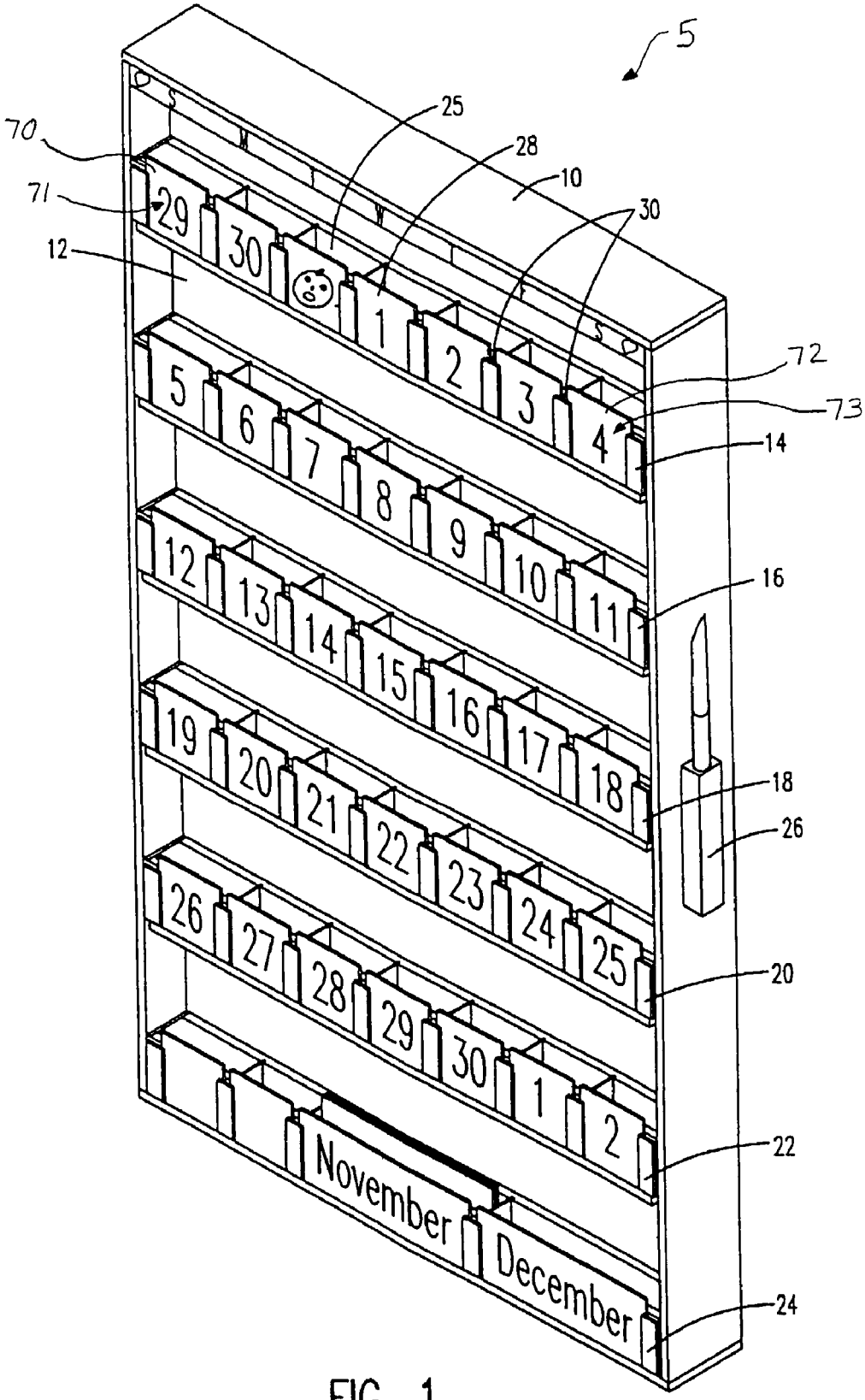
FIG. 1 is a perspective view of an illustrative calendar in accordance with one embodiment of the invention.

FIG. 1 is a perspective view of an illustrative calendar in accordance with one embodiment of the invention. As shown in FIG. 1, calendar 5 includes an outer frame 10 and a backing 12, which in combination form the support chamber for the calendar. Calendar 5 further includes a plurality of storage trays 14, 16, 18, 20, 22, and auxiliary storage tray 24, that are configured for attachment to backing 12 and within frame 10.

As described in further detail below, each of the plurality of storage trays generally include a tray frame. The tray frame may be formed of a combination of walls, including a back wall, a bottom wall, side walls, compartment separators and a front wall. As shown in FIG. 1, the front wall of the storage trays of calendar 5 is comprised of several slotted members 30, or identifier receiving members, for holding calendar identifiers 28. In this embodiment, calendar identifiers 28 are numbered pieces that represent days of the month.

Storage tray 14 is divided into a plurality of storage compartments 25. Each storage compartment 25 is associated with a different calendar day in the calendar period represented with calendar 5. In this embodiment, storage tray 14 represents a week beginning on Sunday, October $29^{th}$, marked by calendar identifier 70 with calendar information 71 illustrating "29", through November $4^{th}$, represented by the calendar identifier 72 with calendar indicia 73 illustrating "4." For storage tray 14 and the other storage trays, each storage compartment 25 has an associated calendar identifier 28 for displaying calendar information. Auxiliary storage tray 24 also includes a plurality of storage compartments, and slots for calendar identifiers. For auxiliary tray 24, calendar identifiers may include calendar information such as the calendar month, "November," or a multi-month or annual calendar piece. The storage compartments for auxiliary storage tray 24 may be used for storing additional month pieces, display cards, calendar identifiers, or reminder cards. Auxiliary storage tray 24 may be located as either the top or bottom row on backing 12, or at other locations as desired.

As shown in FIG. 1, calendar 5 includes five storage trays that represent calendar weeks. While storage trays 14, 16, 18, 20 and 22, each include seven storage compartments, one for each day of the week, it should be appreciated that the number of storage compartments used in a given storage tray, or the number of storage trays used for the calendar may be varied. It should also be appreciated that the components of the calendar, including at least the outer frame, backing, storage trays, and calendar identifiers, may be constructed from a combination of materials, such as wood, plastic, composites and metal, for example.

Calendar 5 includes five storage trays representing weeks and thirty-five calendar identifiers representing those calendar days so that a user may map out a five week schedule. The easy interchangeability of the calendar identifiers allows the user to have a rolling thirty-five day schedule. For example, once the first week of the month is over, storage tray 14 may be rotated down to the bottom of the calendar and used for the first days of the next month (i.e., at the calendar position storage tray 22 is shown in), while each of the trays 16, 18, 20, and 22 are shifted up one calendar position. It should be appreciated that a calendar identifier may include a numbered day piece, or may be exchanged for a "special occasion" piece when appropriate, e.g., "Halloween" or a drawing of a pumpkin, instead of "31." Furthermore, a penholder 26 can be mounted on either side of frame 10 or at other locations for holding pens, markers or other writing instruments.

The storage compartments behind each calendar identifier allow a user to store a number of articles, including reminder cards. Reminder cards may be used to display schedule information representing an event that is scheduled to occur during the calendar period. Individual reminder cards may be used to represent special occasions, such as holidays, birthday, sporting events, appointments, for example. Furthermore, for a storage compartment associated with a child's birthday, the child might use the storage compartment to hold her birthday wishes written on a reminder card. Important dates may be printed on any type of paper or card, or on reusable quick erase cards. Different colored reminder cards may represent special events as well. Reminder cards that are outside of the currently displayed calendar may be stored, for future use, on the auxiliary storage tray or another storage device. The depth of each storage compartment may allow the user to place many different items of interest behind a given date, including keys, credit cards, or even a pair of glasses, for example.

Figure 2:
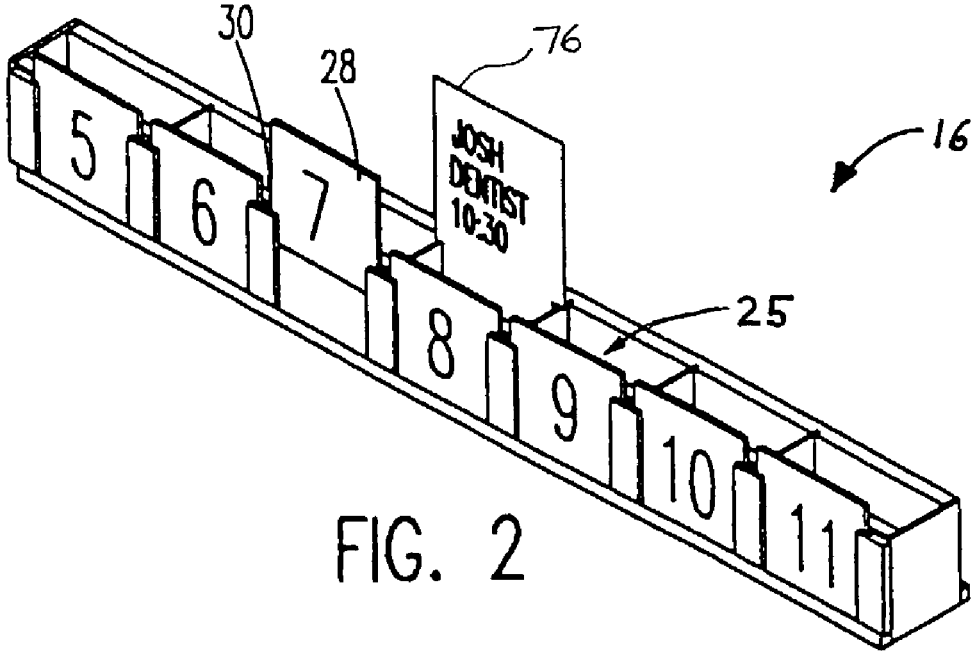
FIG. 2 is a perspective view of an illustrative storage tray in accordance with one embodiment of the invention.

FIG. 2 is a perspective view of a storage tray of FIG. 1 in further detail in accordance with one embodiment of the invention. Storage tray 16 includes seven storage compartments, each having an associated calendar identifier 28, one for each day of the week. As shown in FIG. 2, the calendar identifiers slide down within slotted regions formed by slotted members 30, which each calendar identifier can slide in and out of in order to match the date to the day of the week for that particular month. Reminder card 76, which includes event information "Josh Dentist 10:30," is shown in the storage compartment associated with the "8" calendar identifier. In further embodiments, alternative means of securing calendar identifiers 28 may be used, such as magnets, velcro, for example.

Figure 3:
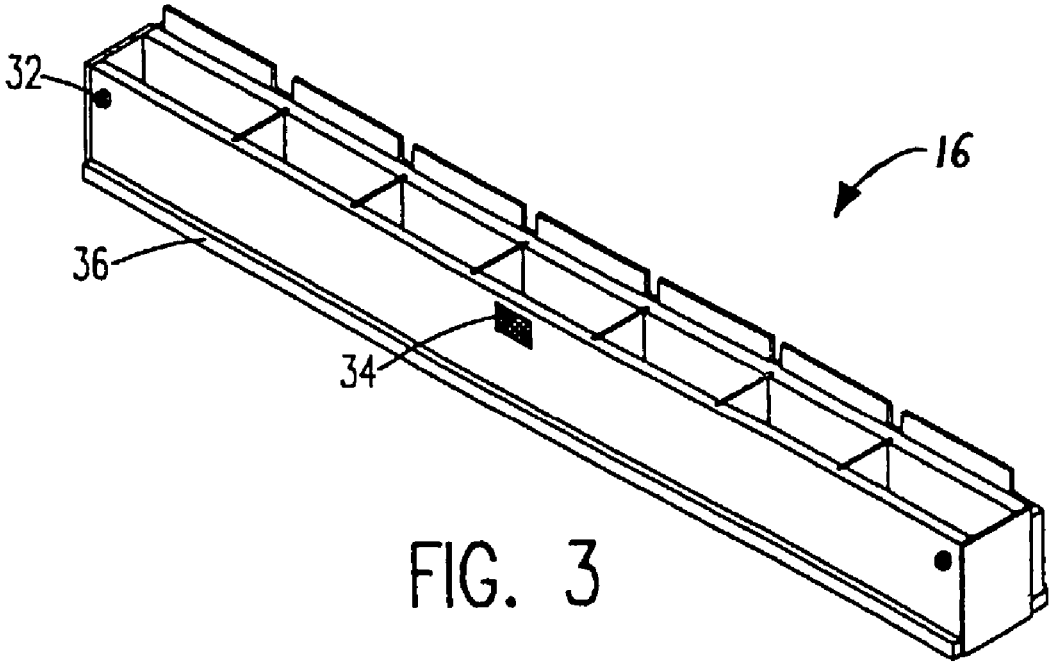
FIG. 3 is a backside perspective view of the storage tray of FIG. 2 in accordance with one embodiment of the invention.
Figure 4:
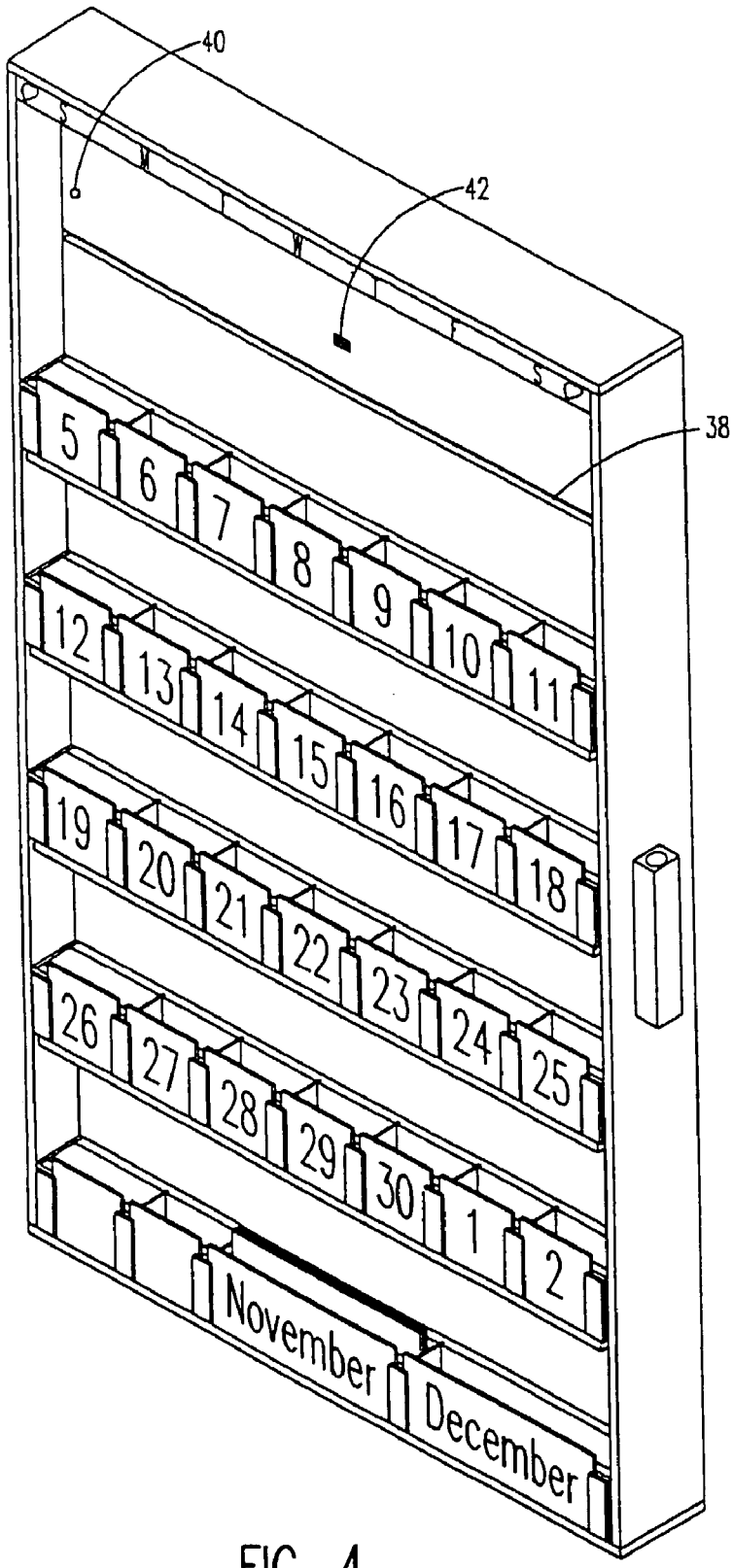
FIG. 4 is a perspective view of the calendar of FIG. 1 in accordance with one embodiment of the invention.

FIG. 3 is a backside perspective view of the storage tray of FIG. 2 in accordance with one embodiment of the invention. As shown in FIG. 3, on each end of the backside there is a metal screw 32 which will attach to a magnet on the backing of the calendar. Velcro connector piece 34 may also be placed in the middle of the backside of storage tray 16 for attachment to a cooperative Velcro connector piece affixed to the calendar backing. Storage tray 16 is constructed so that flange 36 protrudes out from the back side of the storage tray frame. Flange 36 is configured to fit into horizontal slots 38, which are cut into the inside back face of the backing, as shown in FIG. 4. Magnets 40 are mounted on the backing for attachment to the screws affixed on each storage tray. A Velcro connector piece 42 may also be located in the middle of the backing for alignment with each storage tray in the various calendar positions. Other methods of attaching the storage trays to the calendar backing include bayonet connectors, snaps, hooks, holes, pegs, for example, which may be used in place of the magnetic and Velcro attachments.

Figure 5:
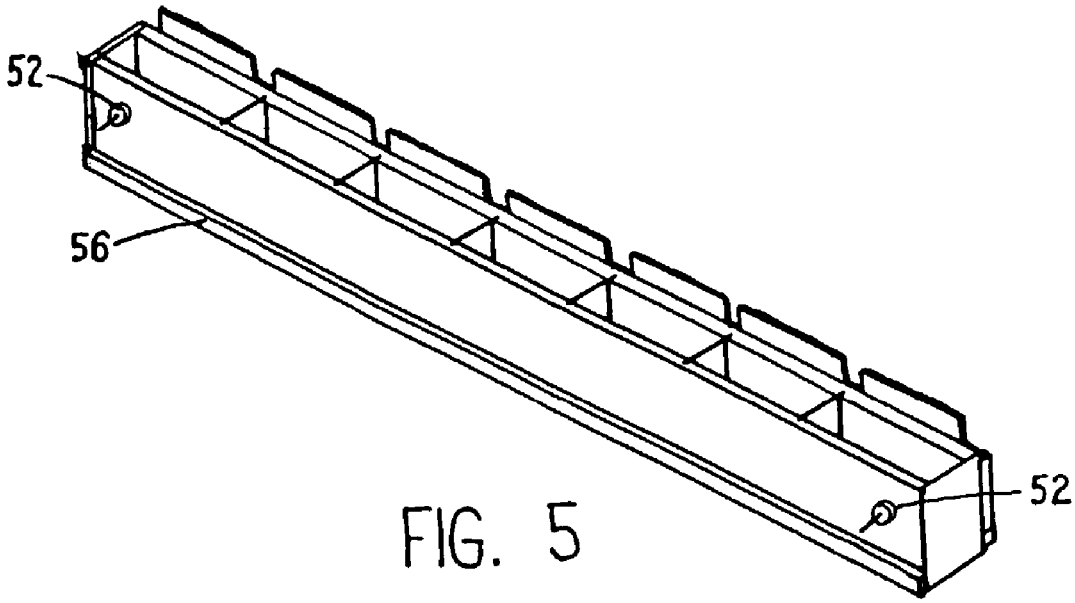
FIG. 5 is a backside perspective view of an illustrative storage tray in accordance with one embodiment of the invention.
Figure 6:
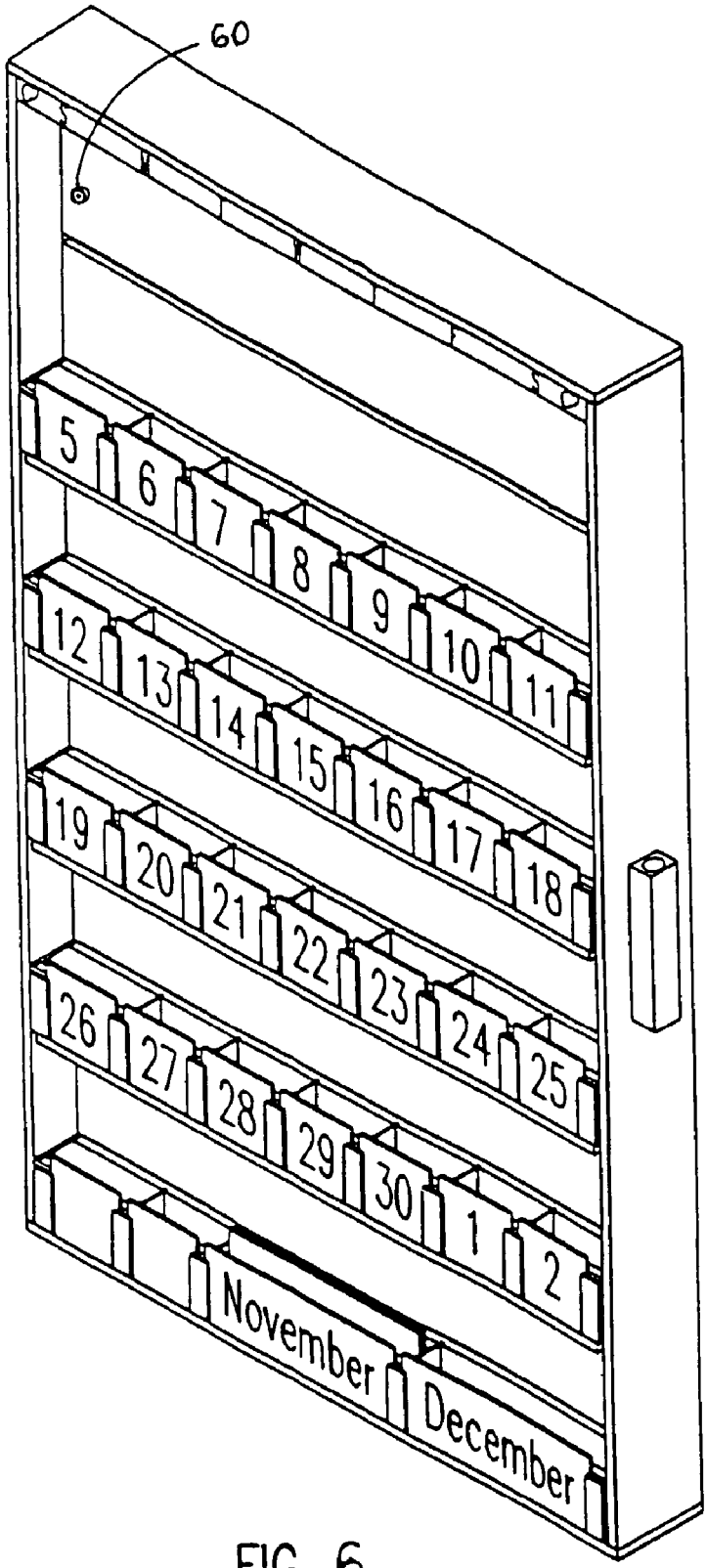
FIG. 6 is a perspective view of an illustrative calendar in accordance with one embodiment of the invention.

FIG. 5 is a backside perspective view of a storage tray in accordance with another embodiment of the invention. As described above, bayonet connectors 52 may be used to attach the storage tray to the inside back face of the backing. Bayonet connectors 52 may be positioned on the backside of the storage tray, similarly positioned as the screws 32 shown in FIG. 3. Bayonet connectors 52 may be secured to bayonet connector receivers 60 positioned on the inside back face of the backing, as shown in FIG. 6. The storage tray also includes flange 56, which protrudes from the back side of the storage tray.

According to this invention, a three dimensional, interchangeable calendar therein utilizes storage spaces behind each individual date to place cards or other items that can serve as reminder of daily commitments. Reusable cards, business cards, or other materials will serve as the reminders. Further, special cards can be tailored for use with the calendar. The calendar includes a set of storage trays, each of which has multiple compartments. Each compartment correlates to a single day. Identifiers, such as numerical indicia on substrates, are associated with each compartment. These identifiers can be removed and re-used on different compartments after a day expires. The storage trays themselves are also movable and positionable at different locations on the housing. The goal of the calendar is to permit the user to cycle in new dates as he or she desires and to maintain essentially a rolling calendar of commitments for the upcoming weeks. Preferably, the calendar accommodates five weeks of dates, thus presenting with enough information to satisfy the length of any single month. In addition, by rolling and cycling though dates, the user can see his or her commitment in parts of any two consecutive months.

Figure 7:
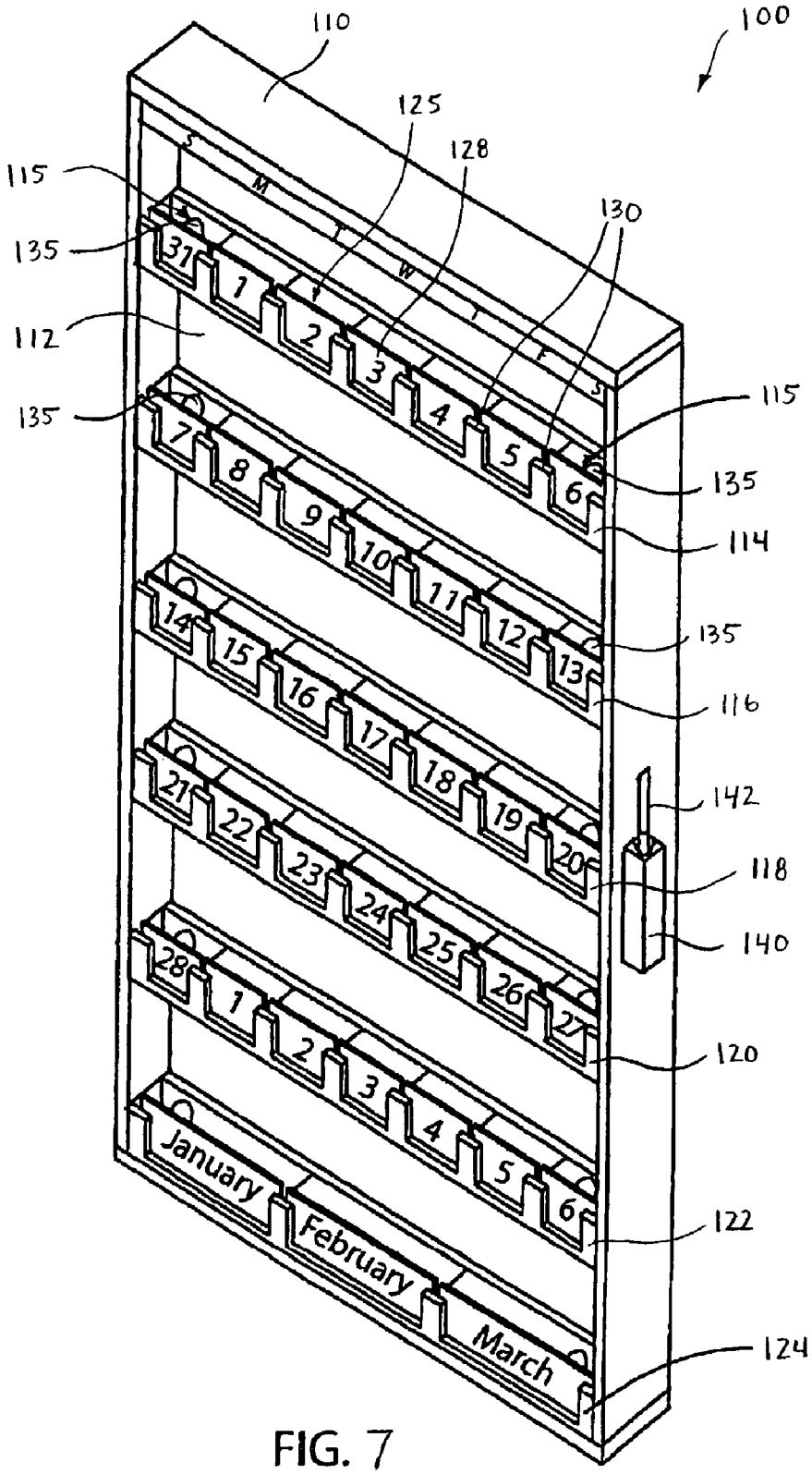
FIG. 7 is a perspective view of an illustrative calendar in accordance with one embodiment of the invention.
Figure 8:
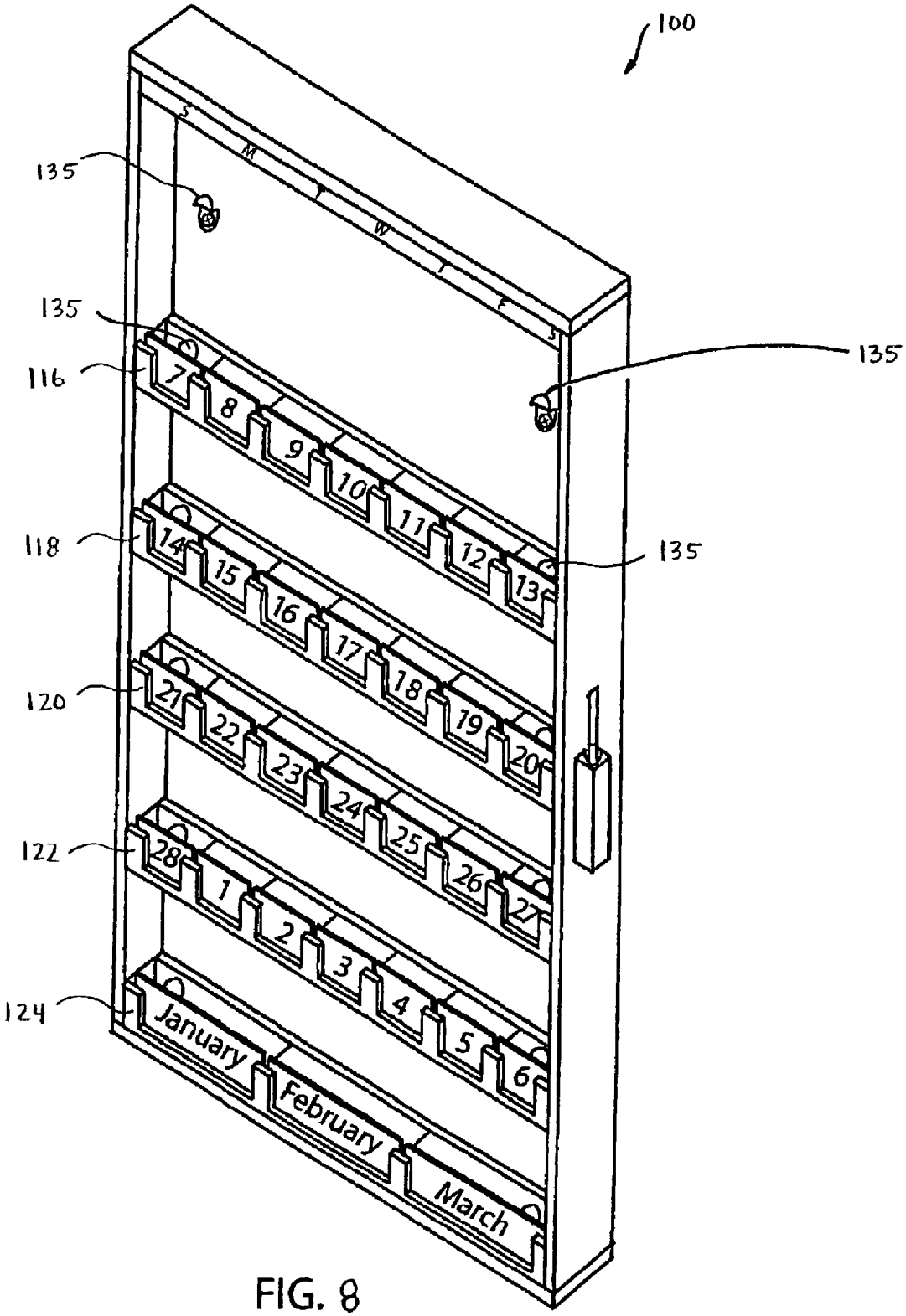
FIG. 8 is a perspective view of the calendar of FIG. 7 in further detail in accordance with one embodiment of the invention.

FIG. 7 is a perspective view of an illustrative calendar in accordance with one embodiment of the invention. As shown in FIG. 7, calendar 100 includes frame 110, backing 112, and a plurality of storage trays 114, 116, 118, 120 and 122. Each of the storage trays 114, 116, 118, 120 and 122 are attached to backing 112 of calendar 100 using cooperating securing mechanisms on each storage tray and backing 112. For example, as shown in FIG. 7, storage tray 114 includes tray securing mechanisms 115, which in this embodiment, are holes formed within the back of storage tray 114. FIG. 8 is a perspective view of the calendar of FIG. 7 in further detail. As shown in FIG. 8, backing securing mechanisms 135 are located on backing 112 for attachment to the tray securing mechanisms 115. In this embodiment, backing securing mechanisms 135 are mirror hooks attached to backing 112. Backing securing mechanisms 135 fit within the tray securing mechanisms 115 and support storage tray 114.

As described above, the storage trays of calendar 100 may be used to represent a calendar period, which may include a week, or in some embodiments, one day. Accordingly, the storage trays are arranged in certain calendar positions. As shown in FIG. 7, storage tray 114 is located in a first calendar position, storage tray 116 in a second calendar position, storage tray 118 in a third calendar position, storage tray 120 in a fourth calendar position, and storage tray 122 in a fifth calendar position. In operation, the user may rotate the storage trays to different calendar positions when desired, such as when a calendar period ends. Illustratively, in FIG. 7, storage tray 114 may be used to represent the Sunday, January $31^{st}$, i.e., "31", and Monday through Saturday of the first week of February, i.e., "1", "2", "3", "4", "5" and "6", respectively. Upon the passing of February $6^{th}$, storage tray 114 may be detached from backing 112, which would allow the user to change the calendar identifiers on storage tray 114 to represent a different calendar period. Following the change of storage tray 114 and its removal from the first calendar position, storage tray 116 may be moved from the second calendar position to the first calendar position, storage tray 118 may be moved from the third calendar position to the second calendar position, storage tray 120 may be moved from the fourth calendar position to the third calendar position, storage tray 122 may be moved from the fifth calendar position to the fourth calendar position, and storage tray 114 may be reattached to backing 112 in the fifth calendar position. Auxiliary storage tray 124 may be located in any position on the calendar as desired in accordance with the invention.

It should be appreciated that calendar 100 may incorporate many of the features of other calendars described herein. Accordingly, storage trays 114, 116, 118, 120 and 122 each include storage compartments 125 for storing articles with an associated calendar date. Calendar identifiers 128, which are associated with storage compartments, are inserted in identifier receiving members 130, which in this embodiment are slotted members. Writing instrument holder 140, which is used to hold writing instrument 142, is attached to frame 110.

While tray securing mechanisms 115 and backing securing mechanisms 135 are in the form of holes and mirror hooks, respectively, many other types of securing mechanisms may be used for attaching the storage trays to the backing. For example, various combinations of hooks, holes, pegs, posts, magnets, screws, Velcro or arrangements of slots formed in the frame or backing. These and other embodiments are described hereinafter.

Figure 9:
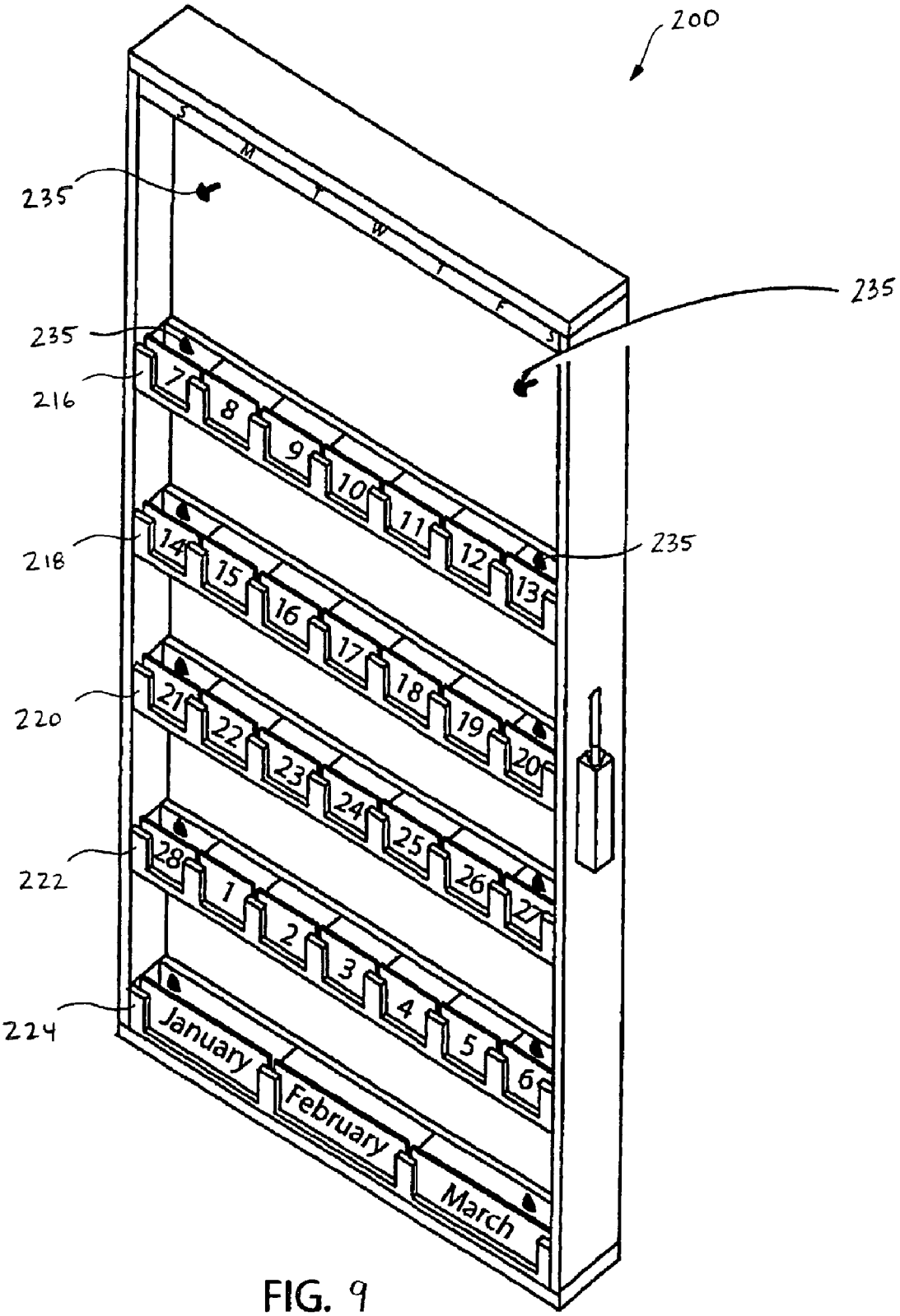
FIG. 9 is a perspective view of an illustrative calendar in accordance with one embodiment of the invention.
Figure 10:
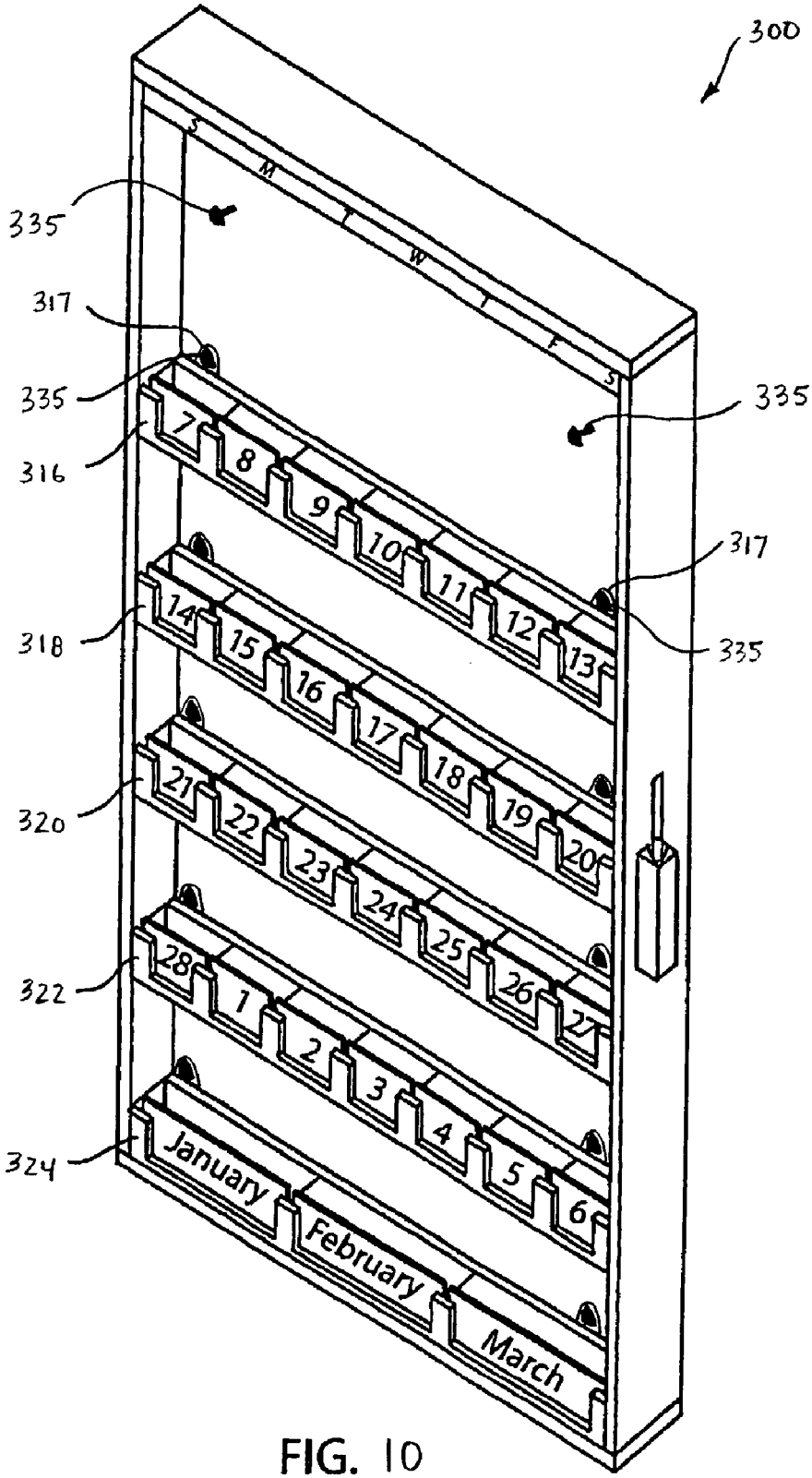
FIG. 10 is a perspective view of an illustrative calendar in accordance with one embodiment of the invention.
Figure 11:
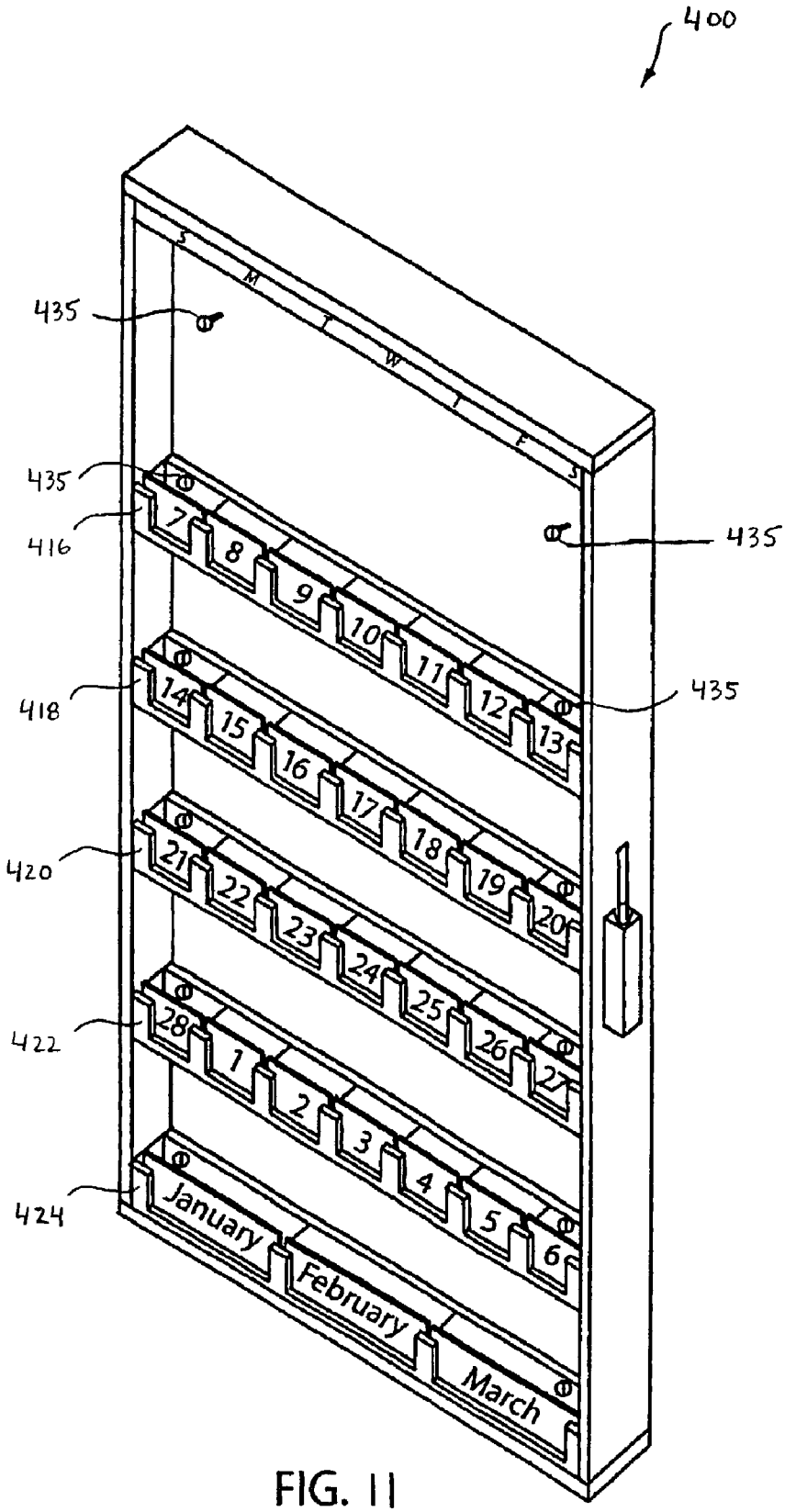
FIG. 11 is a perspective view of an illustrative calendar in accordance with one embodiment of the invention.

FIG. 9 is a perspective view of an illustrative calendar in accordance with one embodiment of the invention. As shown in FIG. 9, backing securing mechanisms 235 include pegs attached to the backing of calendar 200. Storage tray 216 includes tray securing mechanisms in the form of key holes formed within the storage tray 216. FIG. 10 is a perspective view of an illustrative calendar in accordance with one embodiment of the invention. As shown in FIG. 10, backing securing mechanisms 335 include pegs attached to the backing of calendar 300. Storage tray 316 includes tray securing mechanisms 317 in the form of hooks attached to storage tray 316, and slipped over backing securing mechanisms 335, i.e., the pegs, for attaching storage tray 316 to calendar 300. FIG. 11 is a perspective view of an illustrative calendar in accordance with one embodiment of the invention. As shown in FIG. 11, backing securing mechanisms 435 include screws attached to the backing of calendar 400. Storage tray 416 includes tray securing mechanisms in the form of key holes formed within the storage tray 416. It should be appreciated that calendars 200, 300 and 400 may each incorporate features of other calendars described herein. In addition, it should be appreciated that the calendars described herein may utilize many of the various storage trays described herein in accordance with the invention.

Figure 12:
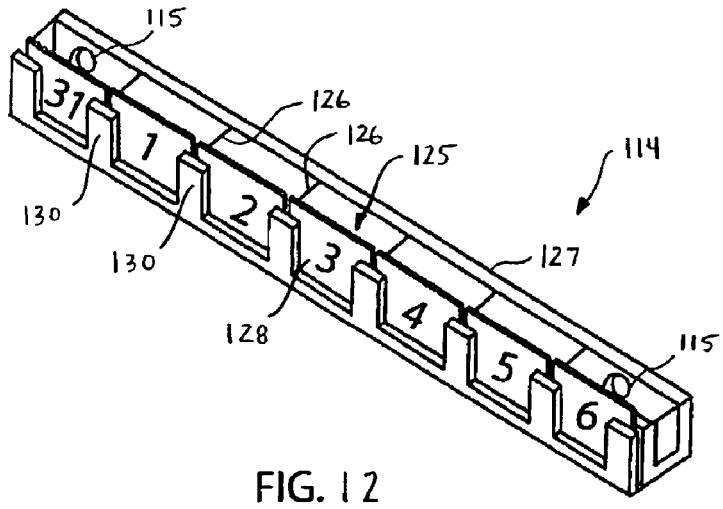
FIG. 12 is a perspective view of an illustrative storage tray of FIG. 7 in further detail in accordance with one embodiment of the invention.
Figure 13:
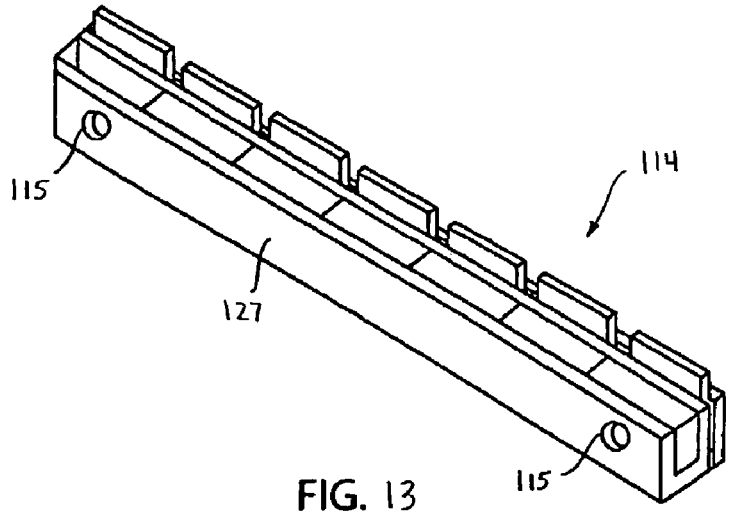
FIG. 13 is a backside perspective view of the storage tray of FIG. 12 in further detail in accordance with one embodiment of the invention.
Figure 14:
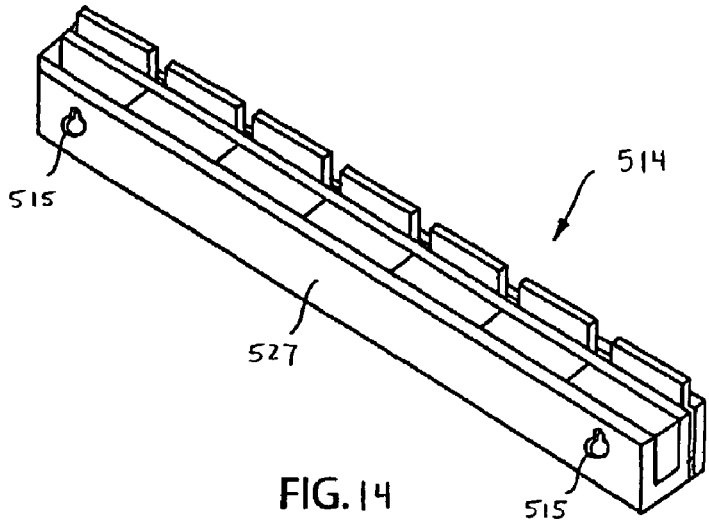
FIG. 14 is a backside perspective view of an illustrative storage tray in accordance with one embodiment of the invention.

FIG. 12 is a perspective view of an illustrative storage tray of FIG. 7 in further detail in accordance with one embodiment of the invention. As shown in FIG. 12, storage tray 114 includes tray securing mechanisms 115, storage compartments 125, compartment separators 126, tray frame 127, calendar identifiers 128 and identifier receiving members 130. FIG. 13 is a backside perspective view of the storage tray of FIG. 12, in which tray securing mechanisms 115 in this embodiment are holes formed in tray frame 127. It should be appreciated that the holes used as tray securing mechanisms may come in varying shapes and sizes, as designed to cooperate with the backing securing mechanisms attached to the calendar backing. Accordingly, FIG. 14 is a backside perspective view of an illustrative storage tray in accordance with another embodiment of the invention. As shown in FIG. 14, storage tray 514 includes tray securing mechanisms 115, which are key-shaped holes formed in tray frame 527.

Figure 15:
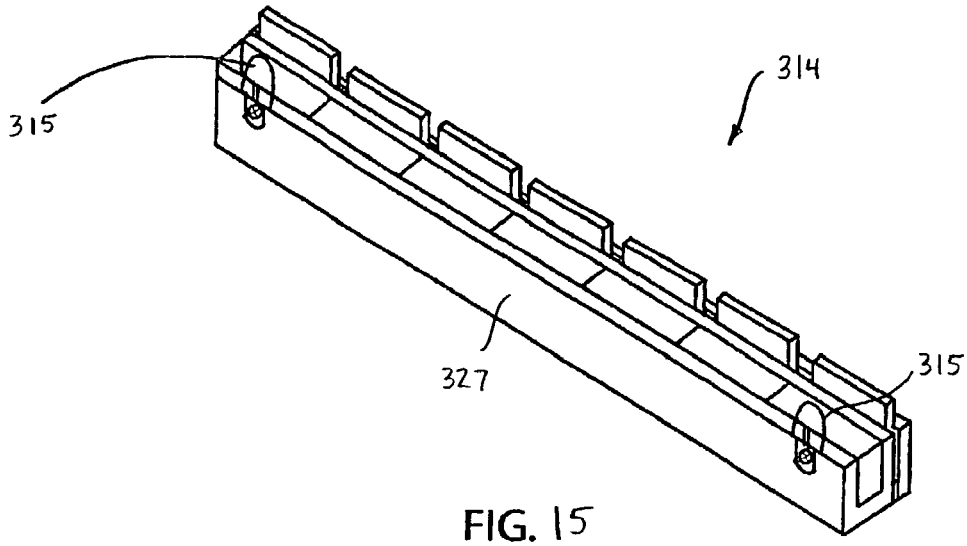
FIG. 15 is a backside perspective view of an illustrative storage tray of FIG. 10 in further detail in accordance with one embodiment of the invention.
Figure 16:
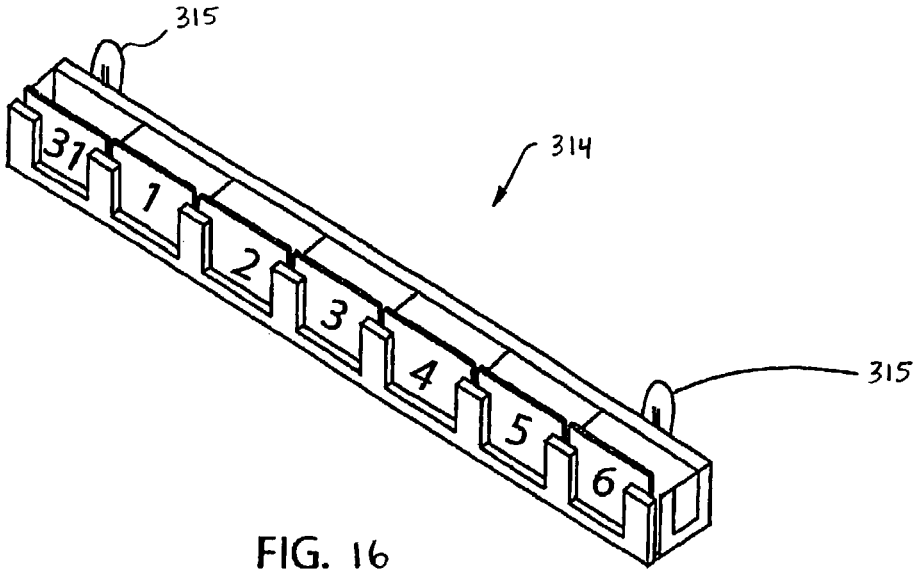
FIG. 16 is a perspective view of the storage tray of FIG. 15 in further detail in accordance with one embodiment of the invention.

FIG. 15 is a backside perspective view of an illustrative storage tray of FIG. 10 in further detail in accordance with one embodiment of the invention. As shown in FIG. 15, storage tray 314 includes tray securing mechanisms 315 attached to tray frame 327. In this embodiment, tray securing mechanisms 315 are hooks for hanging on pegs, posts, screws or other devices extending out from the calendar backing. It should be appreciated that storage tray 314 may incorporate other features of storage trays described herein, such as shown in FIG. 16.

As shown in FIGS. 1-16, various embodiment of the storage trays utilize slotted members located in front of the various storage compartments for inserting calendar identifiers associated with a given storage compartment. However, in further embodiments of the invention, calendar identifiers may comprise the front of the storage compartments.

Figure 17:
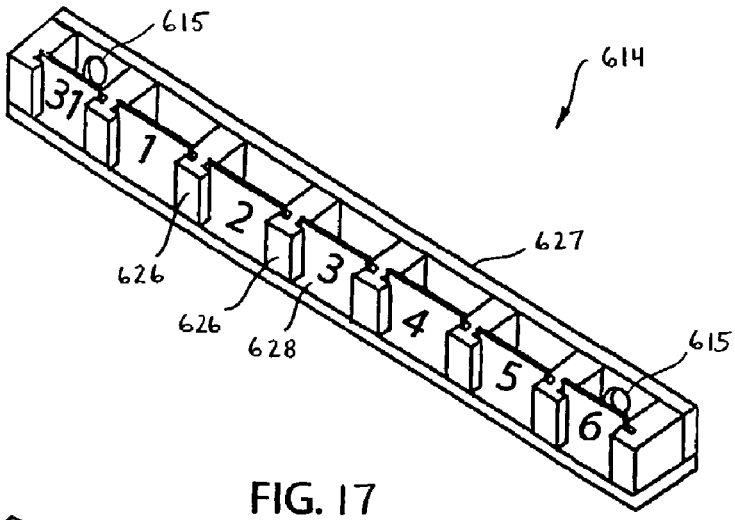
FIG. 17 is a perspective view of an illustrative storage tray in accordance with one embodiment of the invention.
Figure 18:
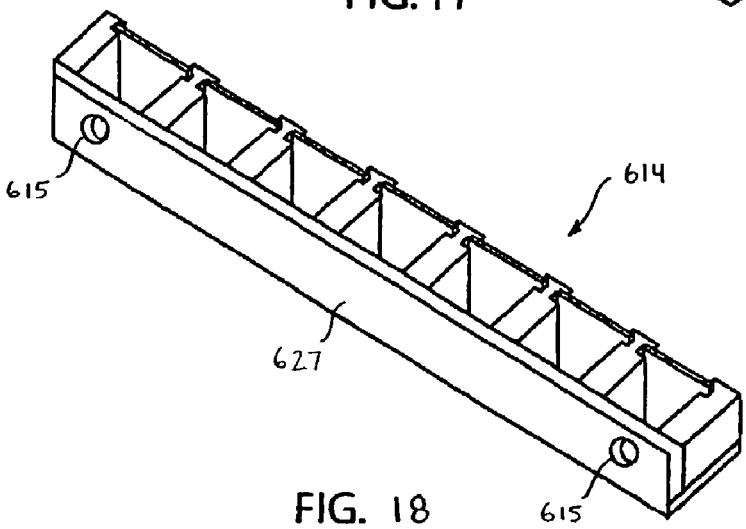
FIG. 18 is a backside perspective view of the storage tray of FIG. 17 in further detail in accordance with one embodiment of the invention.
Figure 19:
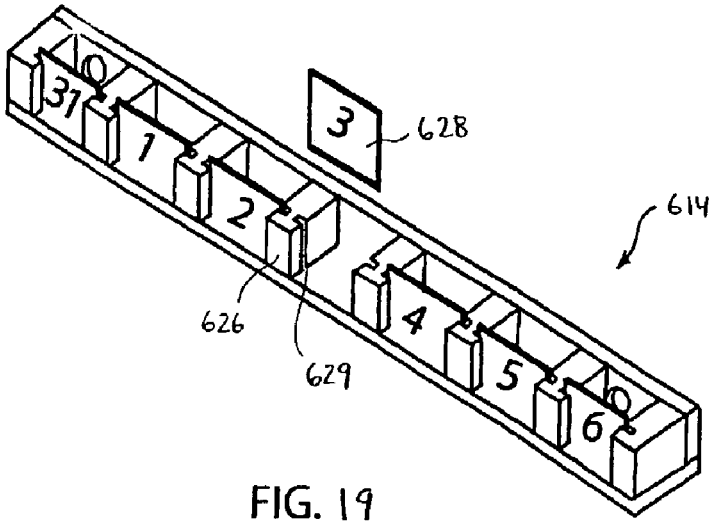
FIG. 19 is a perspective view of the storage tray of FIG. 17 in further detail in accordance with one embodiment of the invention.

FIG. 17 is a perspective view of an illustrative storage tray in accordance with one embodiment of the invention. As shown in FIG. 17, storage tray 614 includes tray frame 627, tray securing mechanisms 615 formed within tray frame 627, compartment separators 626, and calendar identifiers 628. As shown in FIG. 19, slots 629 are formed in the compartment separators 626 for receiving the calendar identifiers 628. FIG. 18 is a backside perspective view of the storage tray of FIG. 17, in which tray securing mechanisms 615 are illustrated in further detail.

Figure 20:
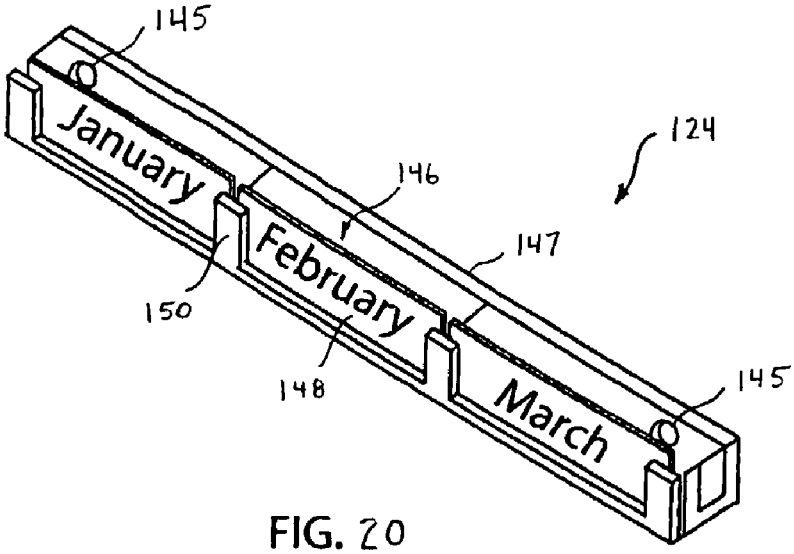
FIG. 20 is a perspective view of an illustrative auxiliary storage tray of FIG. 7 in further detail in accordance with one embodiment of the invention.
Figure 22:
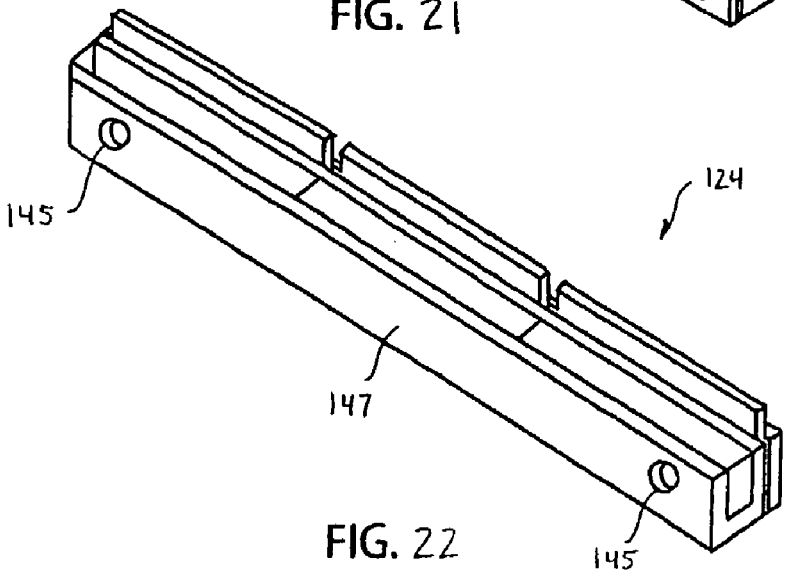
FIG. 22 is a backside perspective view of the storage tray of FIG. 20 in further detail in accordance with one embodiment of the invention.

FIG. 20 is a perspective view of an illustrative auxiliary storage tray of FIG. 7 in further detail in accordance with one embodiment of the invention. As shown in FIG. 20, auxiliary storage tray 124 includes tray frame 147, tray securing mechanisms 145 formed within tray frame 147, storage compartments 146, calendar identifiers 148 and identifier receiving members 150. FIG. 22 is a backside perspective view of the storage tray of FIG. 20, in which tray securing mechanisms 147 are illustrated in further detail.

Figure 21:
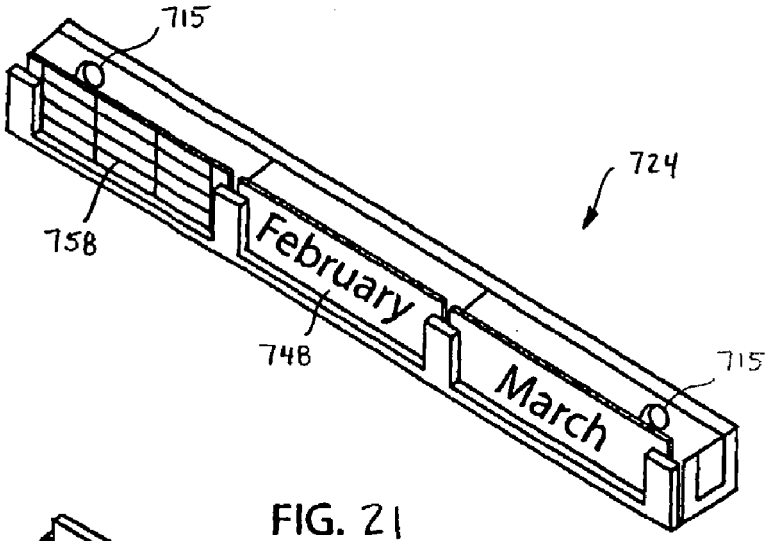
FIG. 21 is a perspective view of an illustrative auxiliary storage tray of FIG. 7 in further detail in accordance with one embodiment of the invention.

FIG. 21 is a perspective view of an illustrative auxiliary storage tray in accordance with one embodiment of the invention. As shown in FIG. 21, storage tray 724 includes a first calendar identifier 748, and a second calendar identifier 758. The second calendar identifier 758, in this embodiment, includes indicia representing an entire calendar year, rather than representing a month, date or special occasion.

Figure 23:
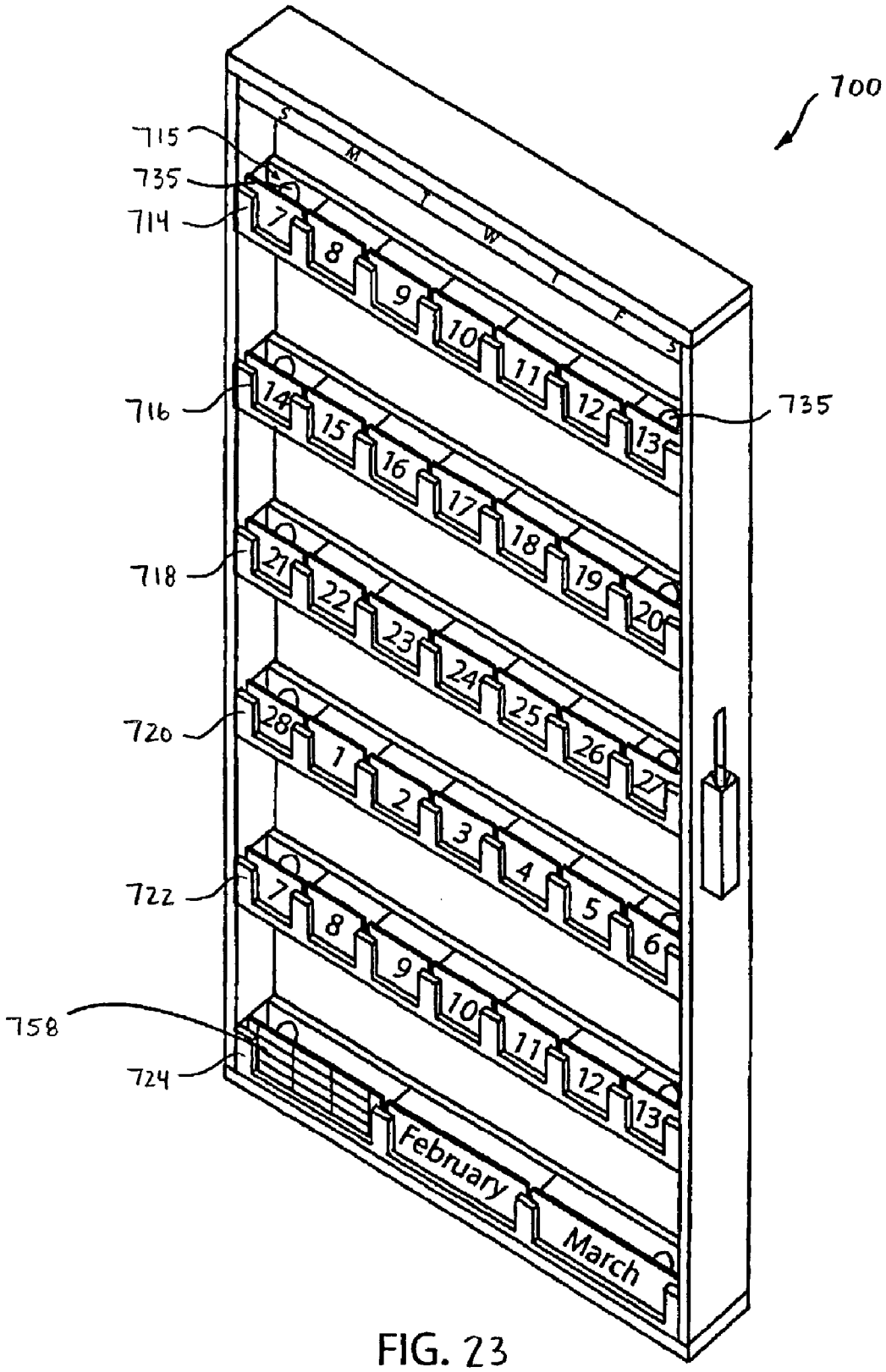
FIG. 23 is a perspective view of an illustrative calendar in accordance with one embodiment of the invention.
Figure 24:
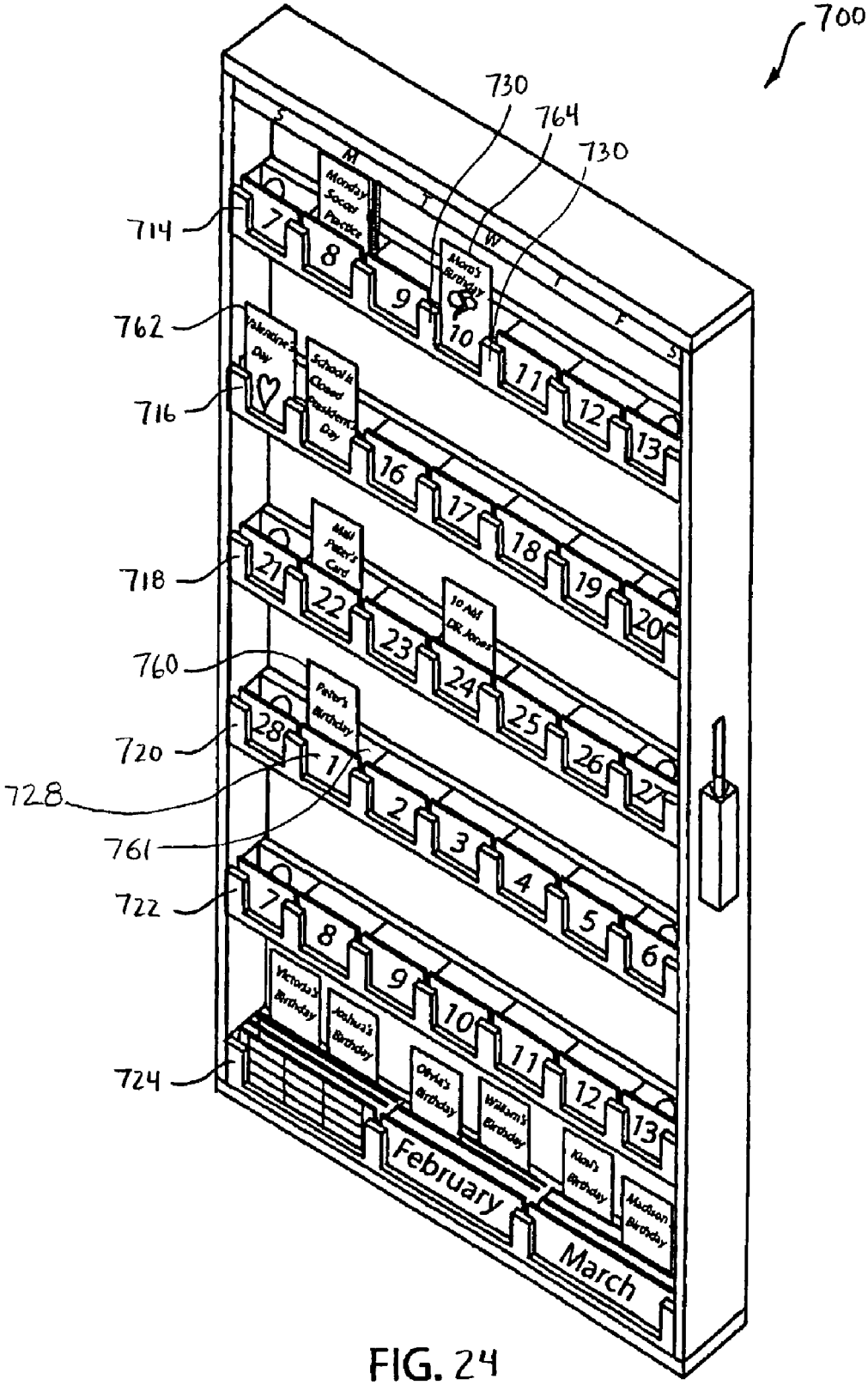
FIG. 24 is a perspective view of an illustrative calendar in accordance with one embodiment of the invention.

FIG. 23 is a perspective view of an illustrative calendar in accordance with one embodiment of the invention. As shown in FIG. 23, calendar 700 includes each of the features of calendar 100 described herein, with the exception that a second calendar identifier 758 with indicia representing an entire calendar year is used on auxiliary storage tray 724. In accordance with the features described above, the user may utilize the various storage trays and calendar identifiers for reminding the user of calendar events, including the use of reminder cards as calendar identifiers. For example, as shown in FIG. 24, reminder card 760 has been inserted in storage compartment 761 behind calendar identifier 728 on storage tray 720, reminder card 762 has been inserted in slots on storage tray 716, thus replacing the calendar identifier representing February $14^{th}$. Furthermore, reminder card 764 has been inserted into slots 730 on storage tray 714. In this embodiment, reminder card 764 includes indicia representing "Mom's Birthday" and "10."

Figure 25:
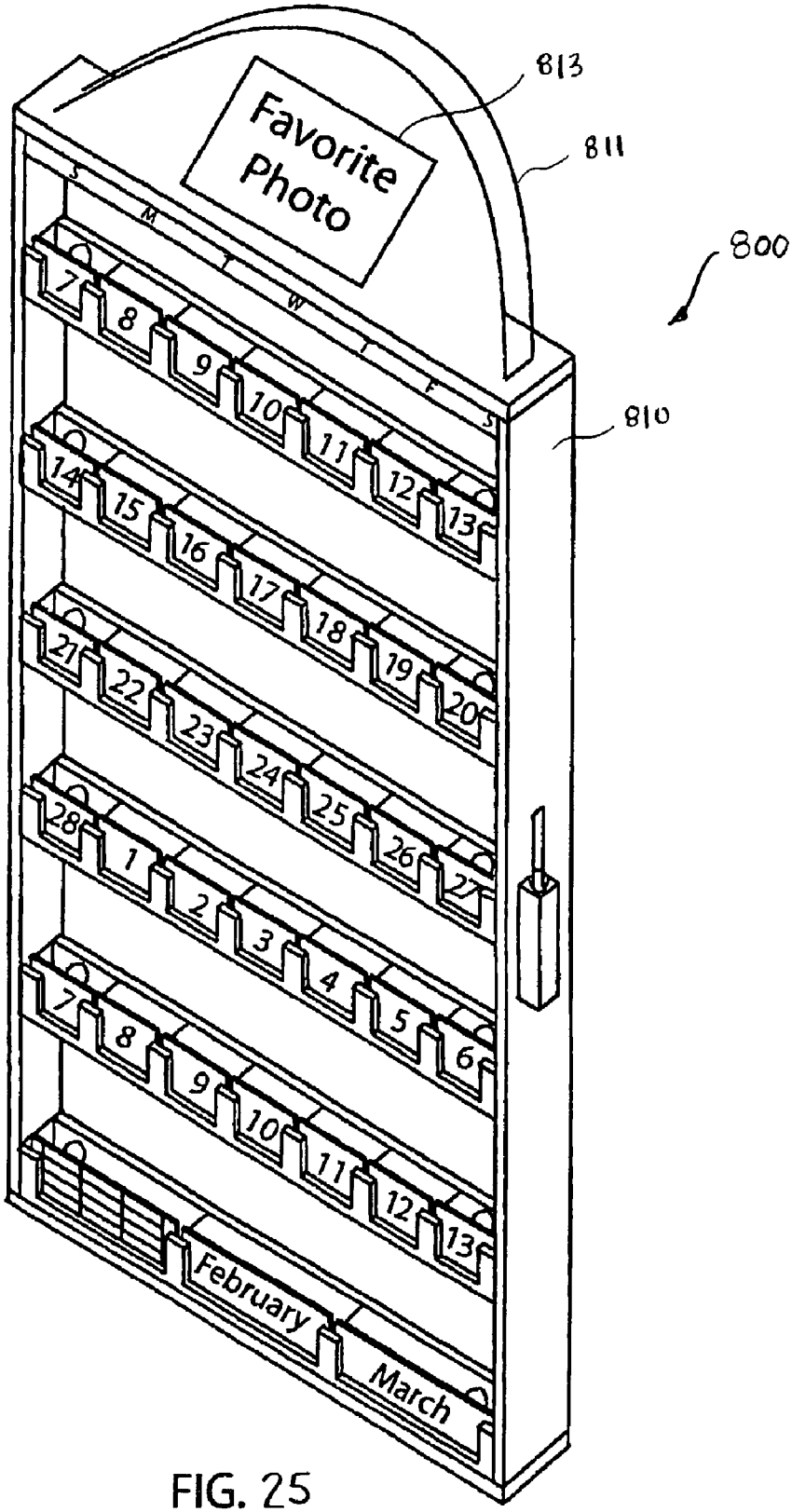
FIG. 25 is a perspective view of an illustrative calendar in accordance with one embodiment of the invention.

FIG. 25 is a perspective view of another illustrative calendar in accordance with one embodiment of the invention. As shown in FIG. 25, display device 811 is attached to frame 810 of calendar 800. Display device 811 may be used to display a memorabilia item 813, which may includes a favorite family photo or other memorabilia. It should be appreciated that display device may be secured to frame 810, or made easily removable.

Figure 26:
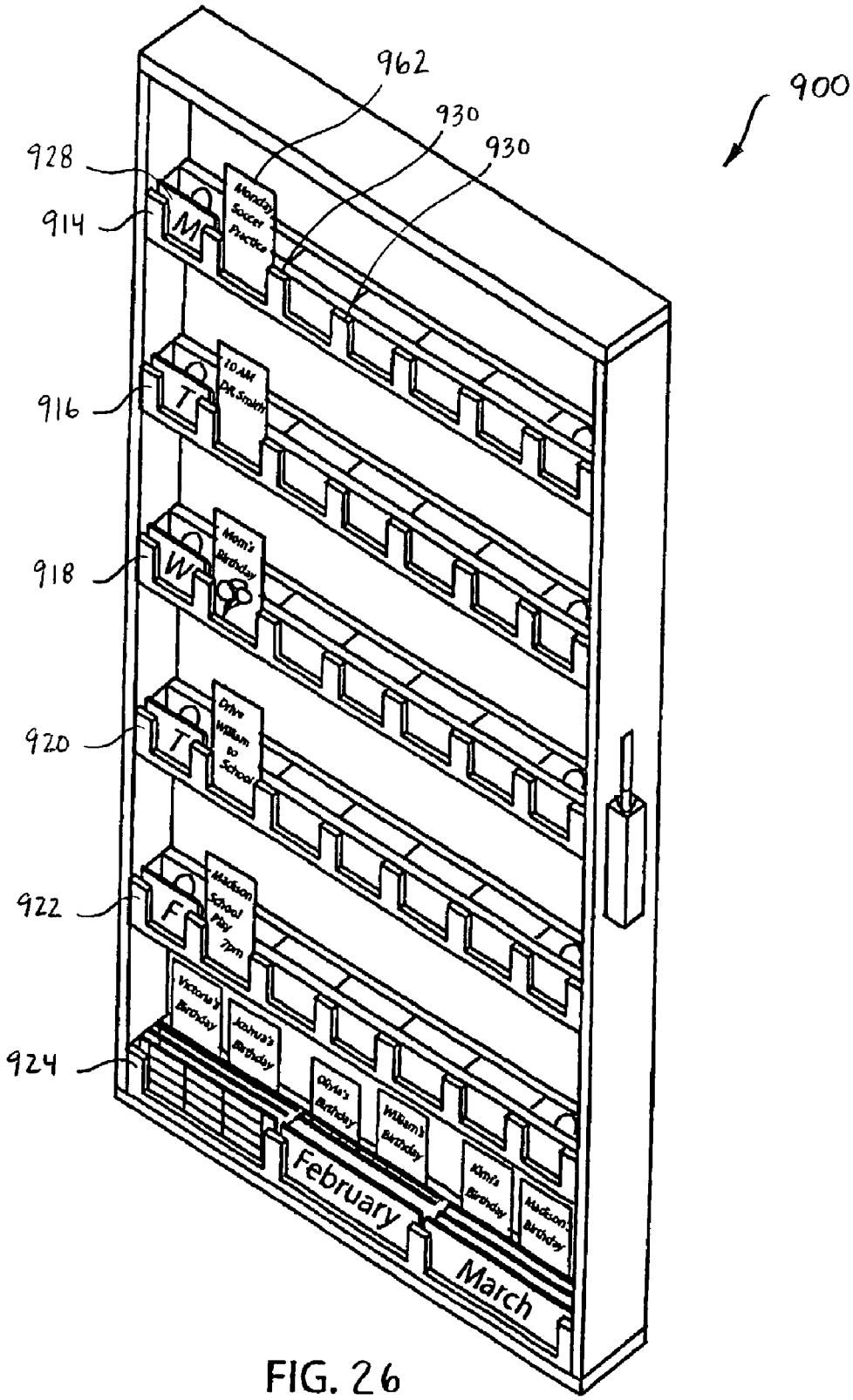
FIG. 26 is a perspective view of an illustrative calendar in accordance with one embodiment of the invention.

As described above, the storage trays of the calendar may represent a calendar week, or a single day of the week. Accordingly, FIG. 26 is a perspective view of an illustrative calendar in accordance with one embodiment of the invention. In this embodiment, calendar 900 includes storage trays 914, 916, 918, 920, and 922, which represent Monday, Tuesday, Wednesday, Thursday and Friday, respectively, of a given week. As shown, calendar identifier 928 includes indicia of "M" representing Monday. Similar to previous embodiments, illustratively, reminder card 962 has been placed in slots of identifier receiving members 930 on storage tray 914.

Figure 27:
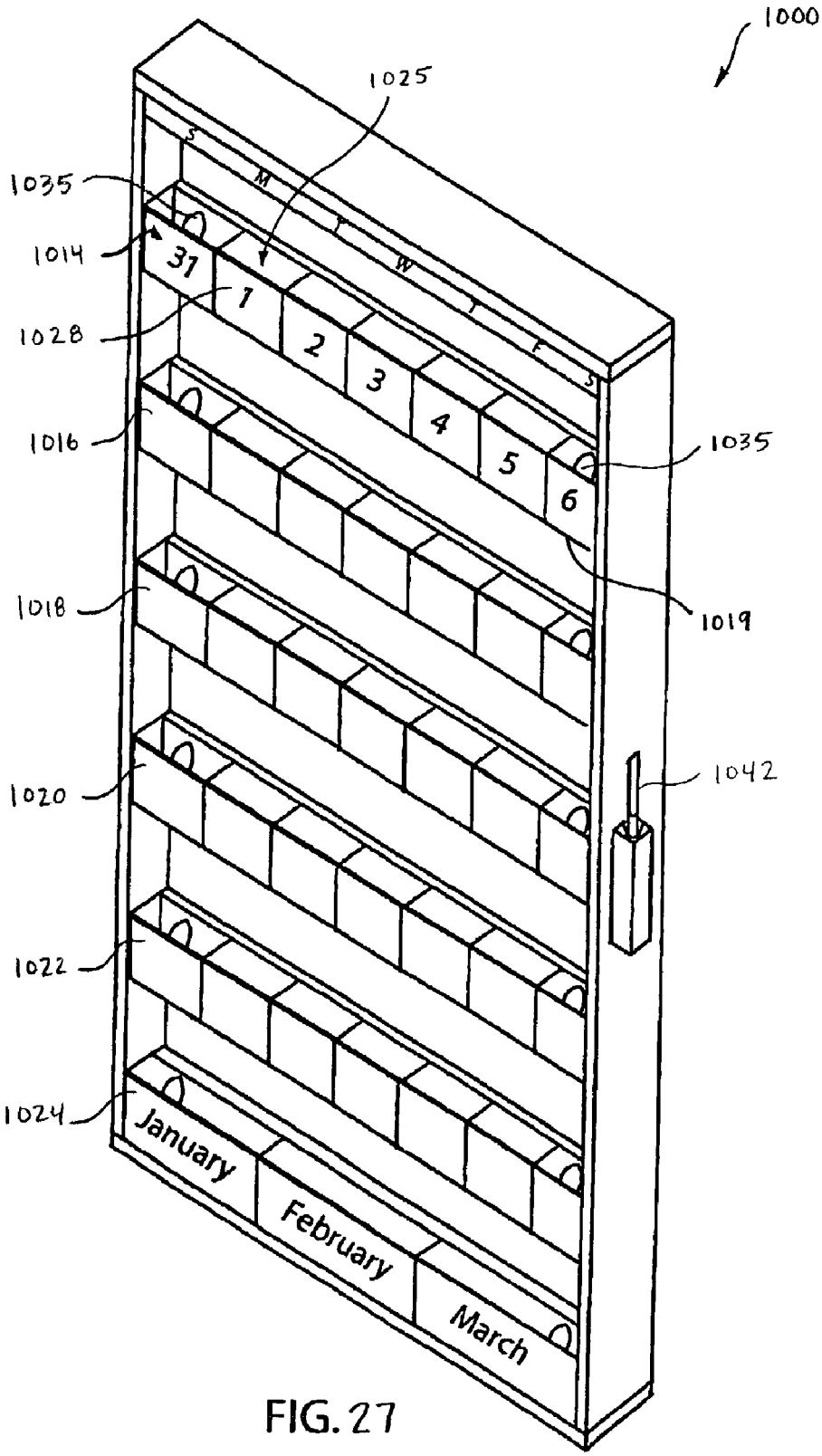
FIG. 27 is a perspective view of an illustrative calendar in accordance with one embodiment of the invention.

Rather than have several numbered calendar identifiers with indicia representing the days of the calendar, each storage tray may be provided with a calendar identifier surface on which the user can ascribe an identifier to each storage compartment as desired. FIG. 27 is a perspective view of an illustrative calendar in accordance with another embodiment of the invention. As shown in FIG. 27, calendar 1000 includes a plurality of storage trays 1014, 1016, 1018, 1020, 1022 and 1024. Each of the storage trays includes an erasable identifier surface, such as identifier surface 1019, in which an individual calendar identifier 1028 for each storage compartment 1025 may be provided. It should also be appreciated that tray securing mechanisms and backing securing mechanisms 1035 on the backing may be used to attach the storage trays to the backing of calendar 1000. Writing instrument 1042 may be used to write calendar identifier indicia on each calendar identifier 1028.

Figure 28:
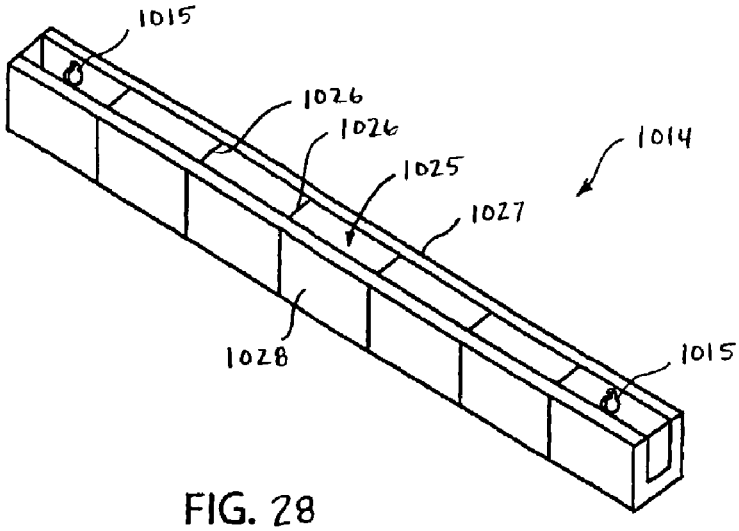
FIG. 28 is a perspective view of an illustrative storage tray of FIG. 27 in further detail in accordance with one embodiment of the invention.
Figure 29:
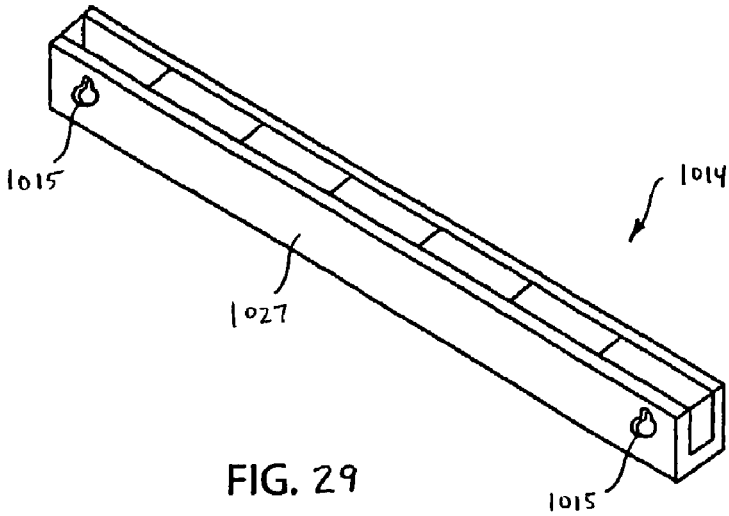
FIG. 29 is a backside perspective view of the storage tray of FIG. 28 in further detail in accordance with one embodiment of the invention.
Figure 30:
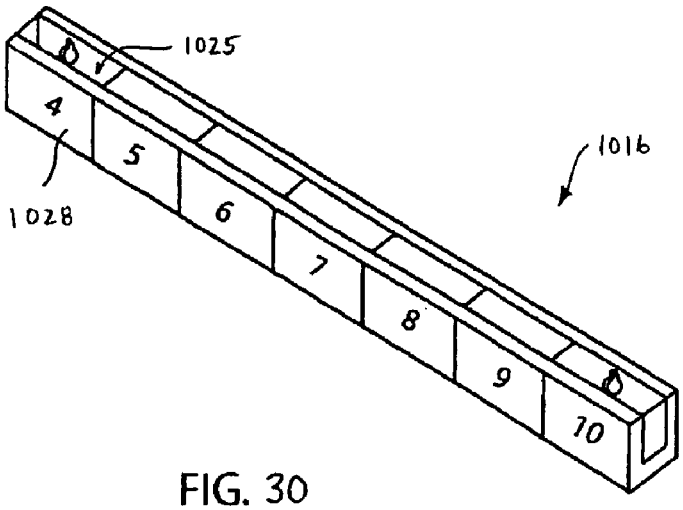
FIG. 30 is a perspective view of an illustrative storage tray of FIG. 28 in further detail in accordance with one embodiment of the invention.

FIG. 28 is a perspective view of an illustrative storage tray of FIG. 27 in further detail in accordance with one embodiment of the invention. As shown in FIG. 28, storage tray 1014 is illustrated with calendar identifiers 1028 on the calendar identifier surface of storage tray 1014 not including any calendar indicia. Similar to the storage trays of embodiments described above, storage tray 1014 includes tray securing mechanisms 1015 (further illustrated in the backside perspective view of FIG. 29), storage compartments 1025, compartment separators 1026 and tray frame 1027. FIG. 30 is a perspective view of an illustrative storage tray of FIG. 27, in which storage tray 1016 is shown with calendar identifiers 1028 which each include calendar information, such as "4", "5", "6", "7", "8", "9" and "10", respectively. However, in this embodiment, the calendar identifier surfaces of the storage trays are comprised of a rewritable surface in which the user may write calendar indicia for the calendar identifiers associated with each storage compartment, and change the calendar indicia as desired using an eraser device to remove the calendar indicia. Illustratively, the calendar identifier surface may be comprised of a slate material, such as a chalk board surface, an erasable plastic board surface, or other device that may display information supplied by a user, and may be changed by the user as desired.

Figure 31:
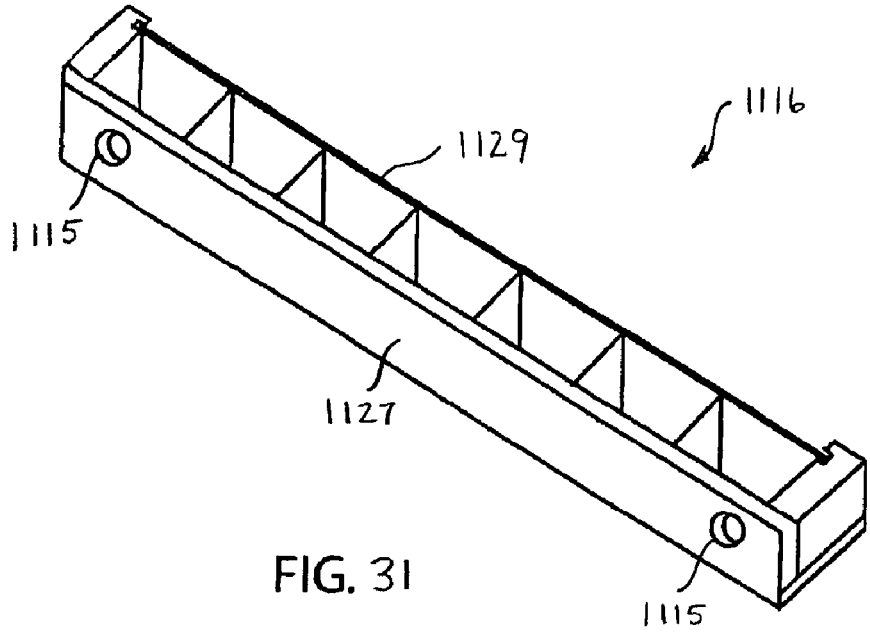
FIG. 31 is a backside perspective view of an illustrative storage tray in accordance with one embodiment of the invention.
Figure 32:
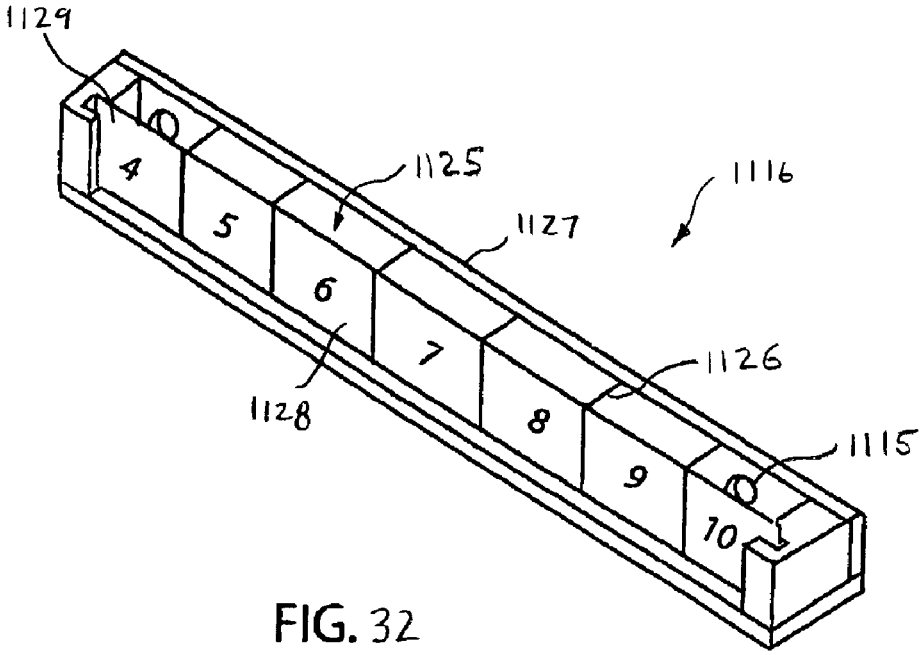
FIG. 32 is a perspective view of the storage tray of FIG. 31 in further detail in accordance with one embodiment of the invention.

FIG. 32 is a perspective view of an illustrative storage tray in accordance with one embodiment of the invention. As shown in FIG. 32, storage tray 1116 is comprised of tray frame 1127, which has tray securing mechanisms 1115 formed within it. In this embodiment, the individual storage compartments 1125 are formed by tray frame 1127, compartment separators 1126, and calendar identifier 1129, which is comprised of a rewritable surface, makes up the front of each storage compartment 1125. As shown in FIG. 32, calendar identifier 1129 is fitted within slotted members formed within the side walls of tray frame 1127. FIG. 31 is a backside perspective view of storage tray 1116, in which calendar indicia is presented on calendar identifier 1129 in calendar identifier regions 1128 as associated with each individual storage compartment 1125.

Figure 33:
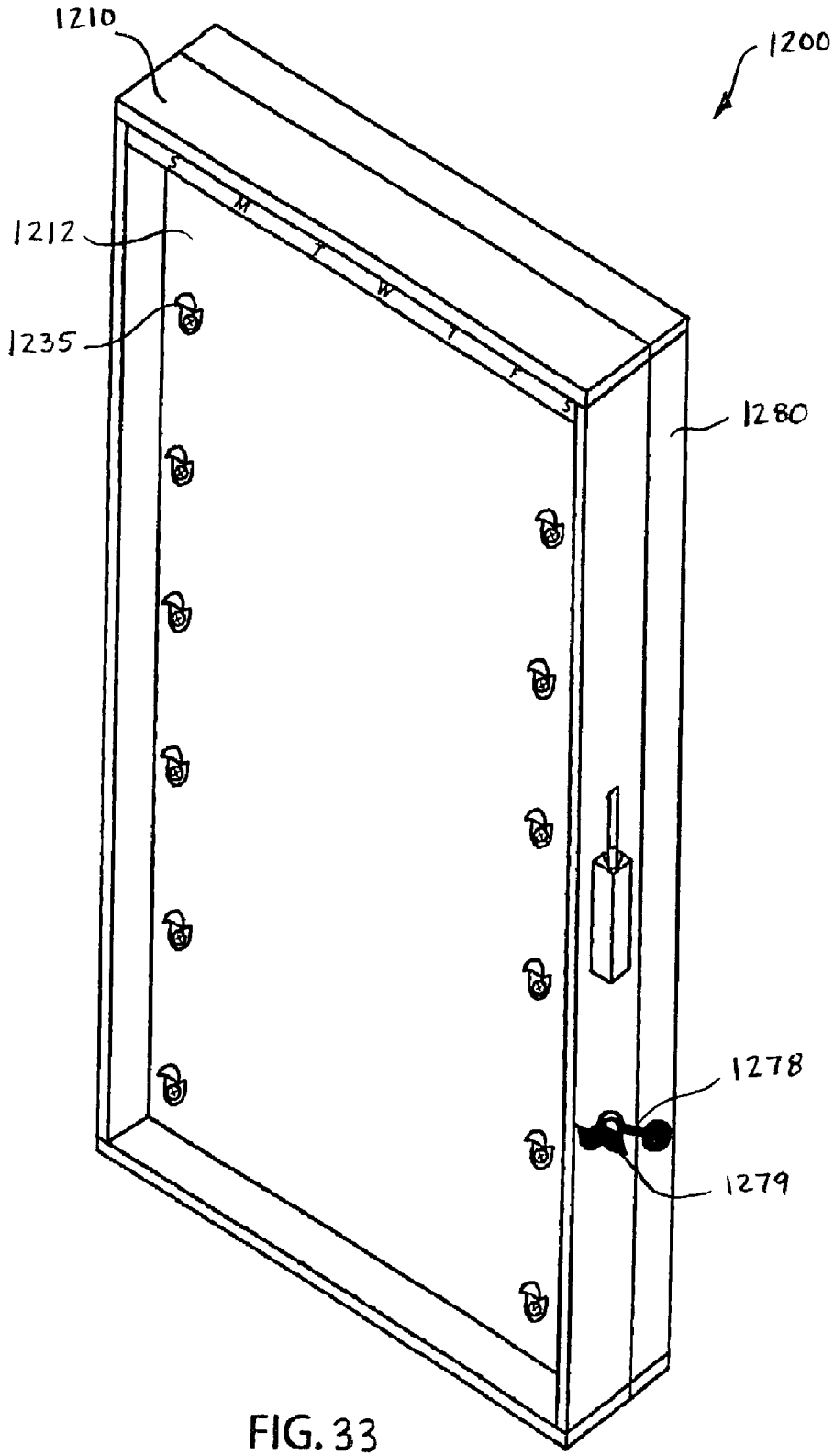
FIG. 33 is a perspective view of an illustrative calendar with storage cabinet in accordance with one embodiment of the invention.
Figure 34:
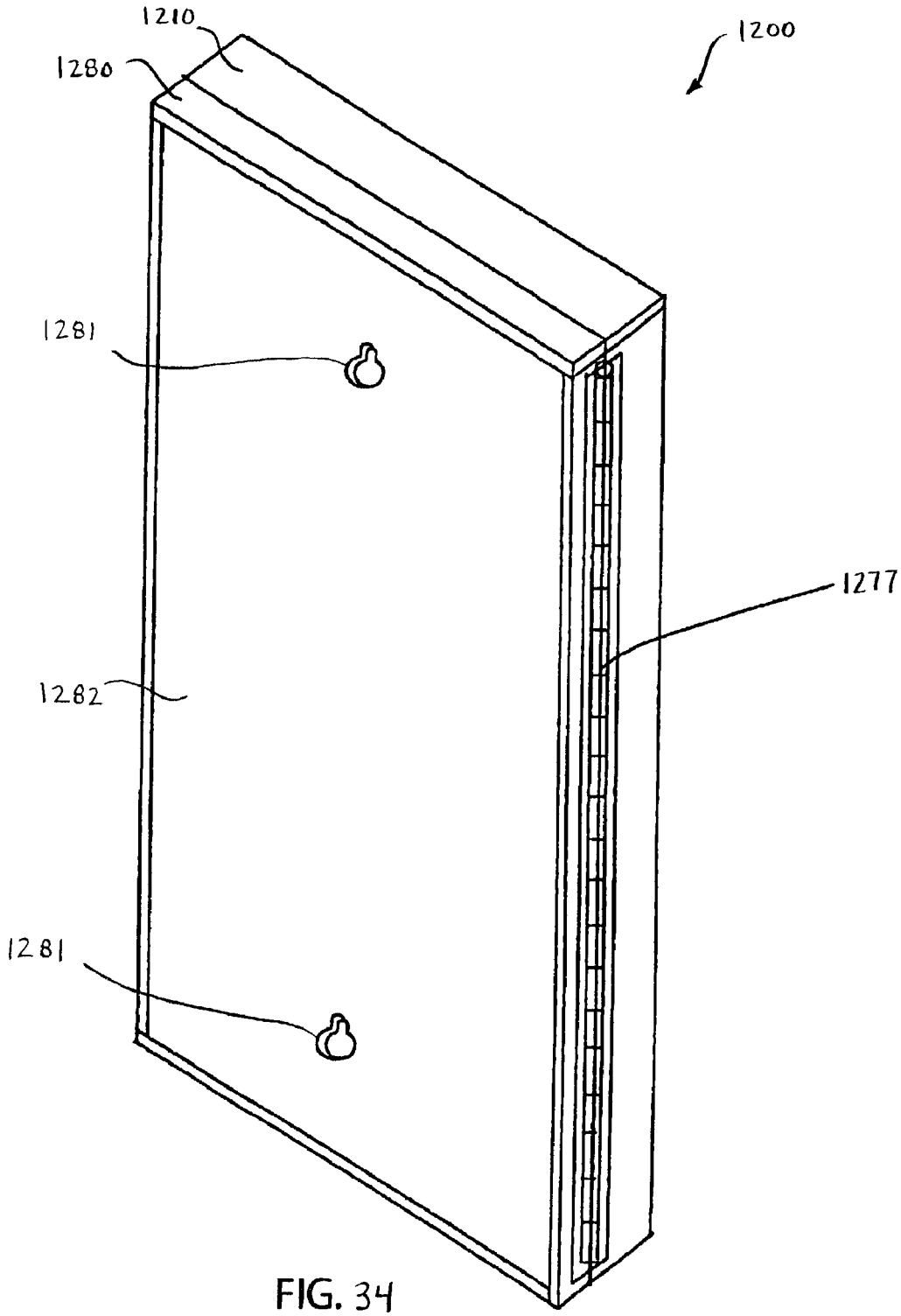
FIG. 34 is a backside perspective view of the calendar of FIG. 33 in accordance with one embodiment of the invention.

While various embodiments of calendars in accordance with the invention have been described above, additional fixtures may be added to the calendars to increase the usability of the devices. Accordingly, FIG. 33 is a perspective view of an illustrative calendar with storage cabinet in accordance with another embodiment of the invention. FIG. 34 is a backside perspective view of the calendar of FIG. 33. As shown in FIGS. 33-34, calendar 1200 includes frame 1210 to which storage cabinet 1280 is hingedly attached at hinge 1277. Similar to the embodiment described above, calendar backing 1212 has a plurality of securing mechanisms 1235 affixed to it. The hinged attachment of calendar frame 1210 and storage cabinet 1280 may function similar to a door and cabinet relationship, in which items may be stored in storage cabinet 1280 for later use, and calendar frame 1210 and backing 1212 may be used with storage trays as described above. The interior of storage cabinet 1280 is closed off by securing calendar frame 1210 and backing 1212 to the face of storage cabinet 1280 using latch 1278, which is attached to storage cabinet 1280, to fit over pin 1279 attached on calendar frame 1210. Holes 1281 may be formed within the storage cabinet backing 1282 for hanging calendar 1200 on a wall or other location.

Figure 35:
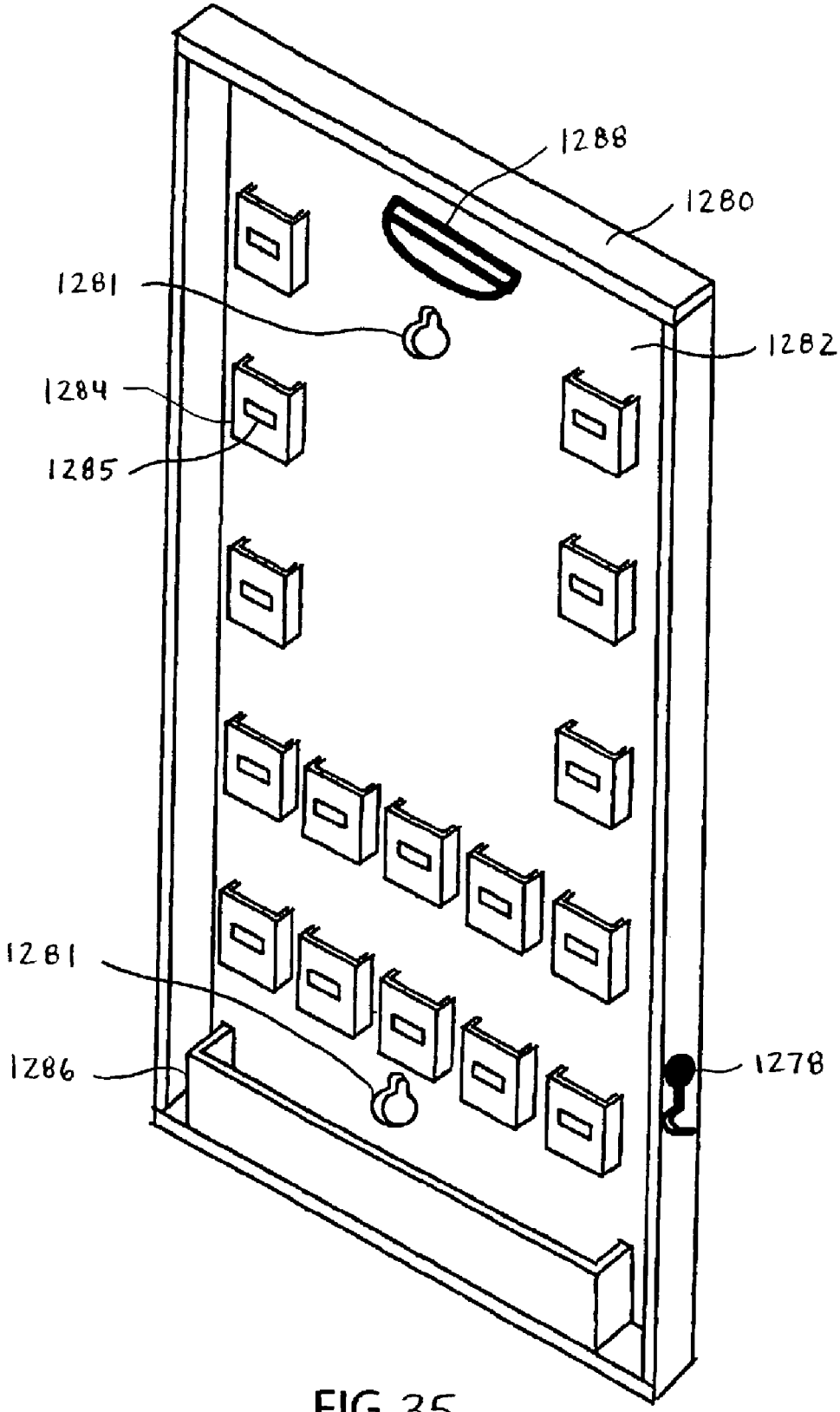
FIG. 35 is a perspective view of the interior of the storage cabinet of FIGS. 33-34 in further detail in accordance with one embodiment of the invention.

FIG. 35 is a perspective view of the interior of storage cabinet of FIGS. 33-34 in further detail in accordance with one embodiment of the invention. As shown in FIG. 35, a plurality of devices may be attached to storage cabinet backing 1282 for storing various materials and items that may be used in accordance with the calendar, or for other uses. For example, a plurality of storage trays 1284 may be used for storing reminder cards used with calendar 1200, or other items, and storage trays 1284 may have identifiers 1285 on the face of each tray 1284. At least one large storage tray 1286 has been included, and may be used to store large reminder cards or calendar identifiers not in use on calendar 1200. In addition, a spring clip 1288 is attached to backing 1282 for securing papers or other items.

Figure 36:
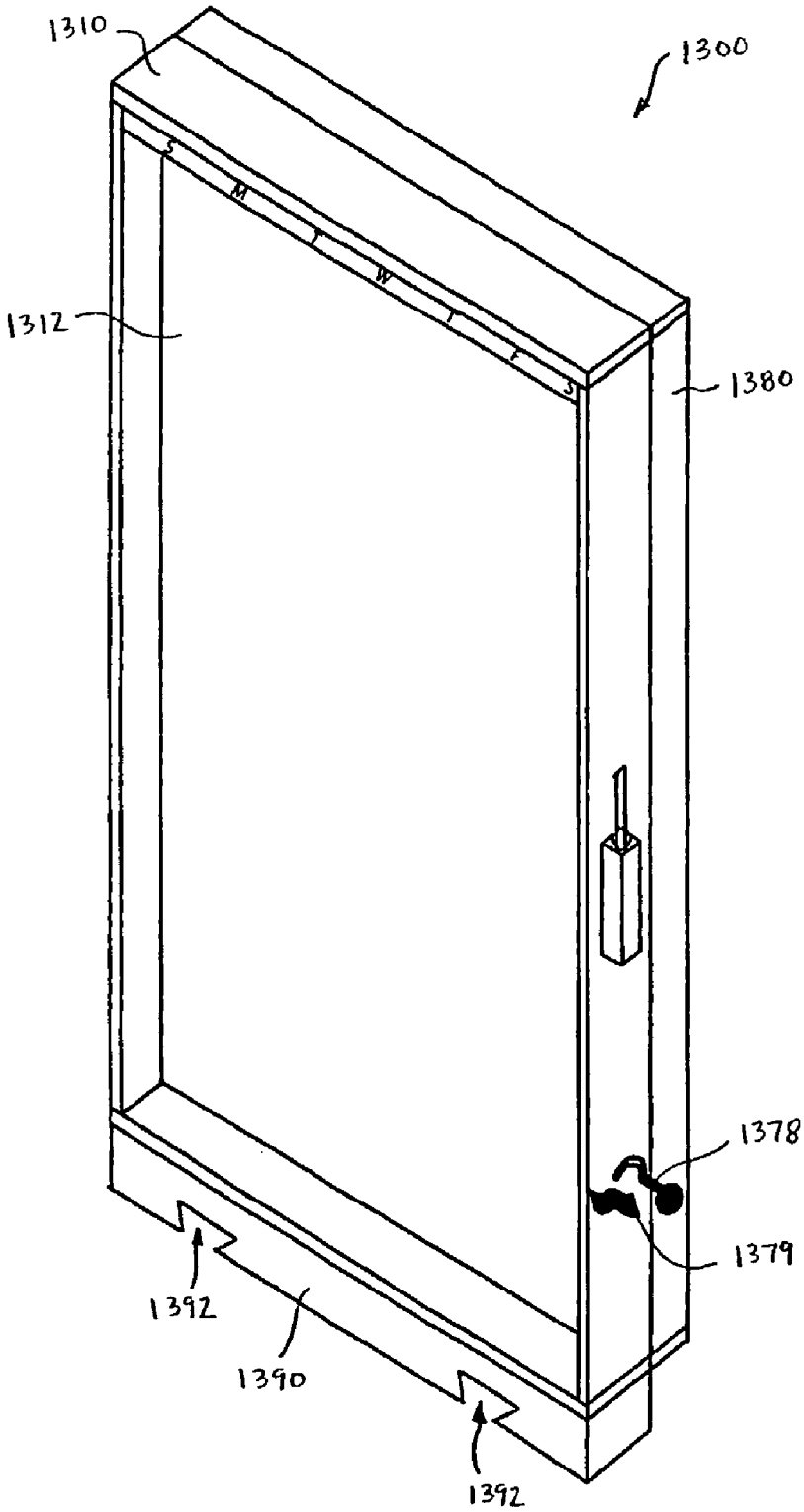
FIG. 36 is a perspective view of an illustrative calendar with storage cabinet and accessory fixture in accordance with one embodiment of the invention.
Figure 37:
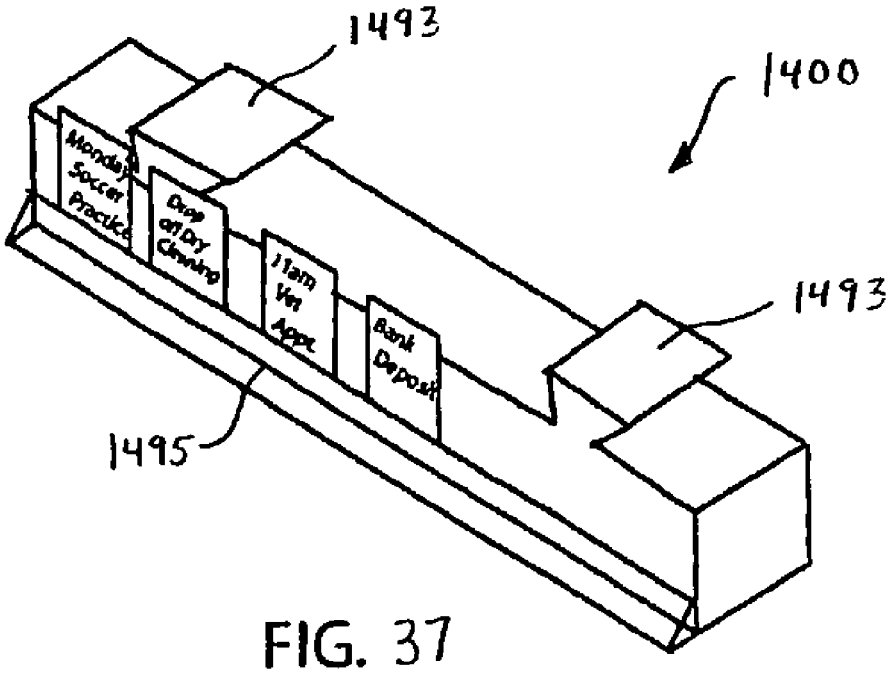
FIG. 37 is a perspective view of an illustrative accessory attachment device in accordance with one embodiment of the invention.
Figure 38:
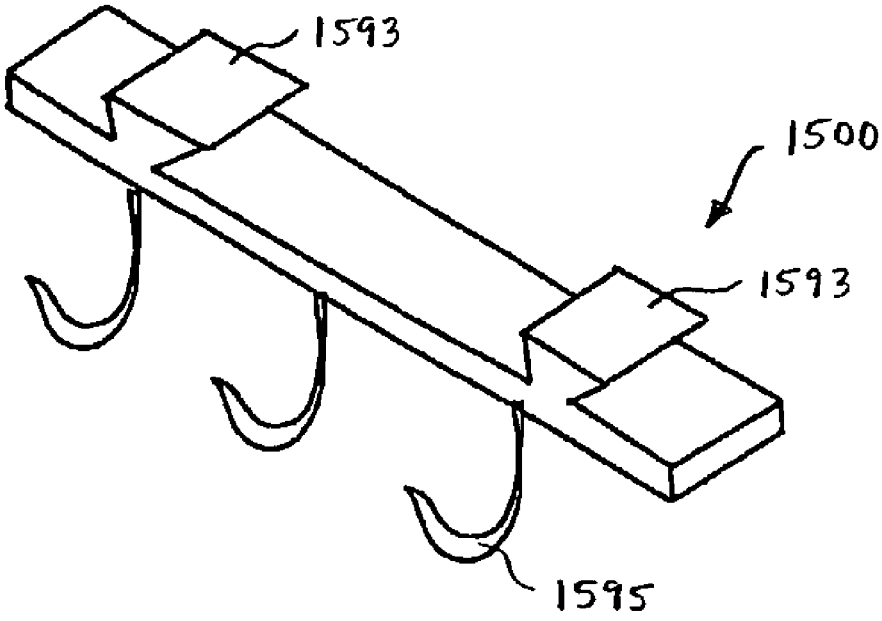
FIG. 38 is a perspective view of an illustrative accessory attachment device in accordance with one embodiment of the invention.

As described above, many different fixtures and devices may be attached to the calendars to provide additional storage capabilities or other functions. FIG. 36 is a perspective view of an illustrative calendar with storage cabinet and accessory fixture in accordance with one embodiment of the invention. As shown in FIG. 36, calendar 1300 is comprised of calendar frame 1310 and backing 1312, which are hingedly attached to storage cabinet 1380. Accessory fixture 1390 is attached to the bottom of calendar frame 1310. Slots 1392 are formed within accessory fixture 1390 for receiving an accessory attachment device. In accordance with one embodiment of the invention, FIGS. 37-38 are illustrative accessory attachment devices for use with accessory fixtures. As shown in FIG. 37, accessory attachment device 1400 includes slides 1493 for inserting into the slots of the accessory fixture attached to the calendar frame. Similarly, accessory attachment device 1500 includes slides 1593 for inserting into the slots of the accessory fixture attached to the calendar frame. Accessory attachment device 1400 further includes ledge 1495 that may be used to secure reminder cards, as shown in FIG. 37. Accessory attachment device 1500 further includes hooks 1595 that may be used to hang items, such as clothing, keys or other items.

Figure 39:
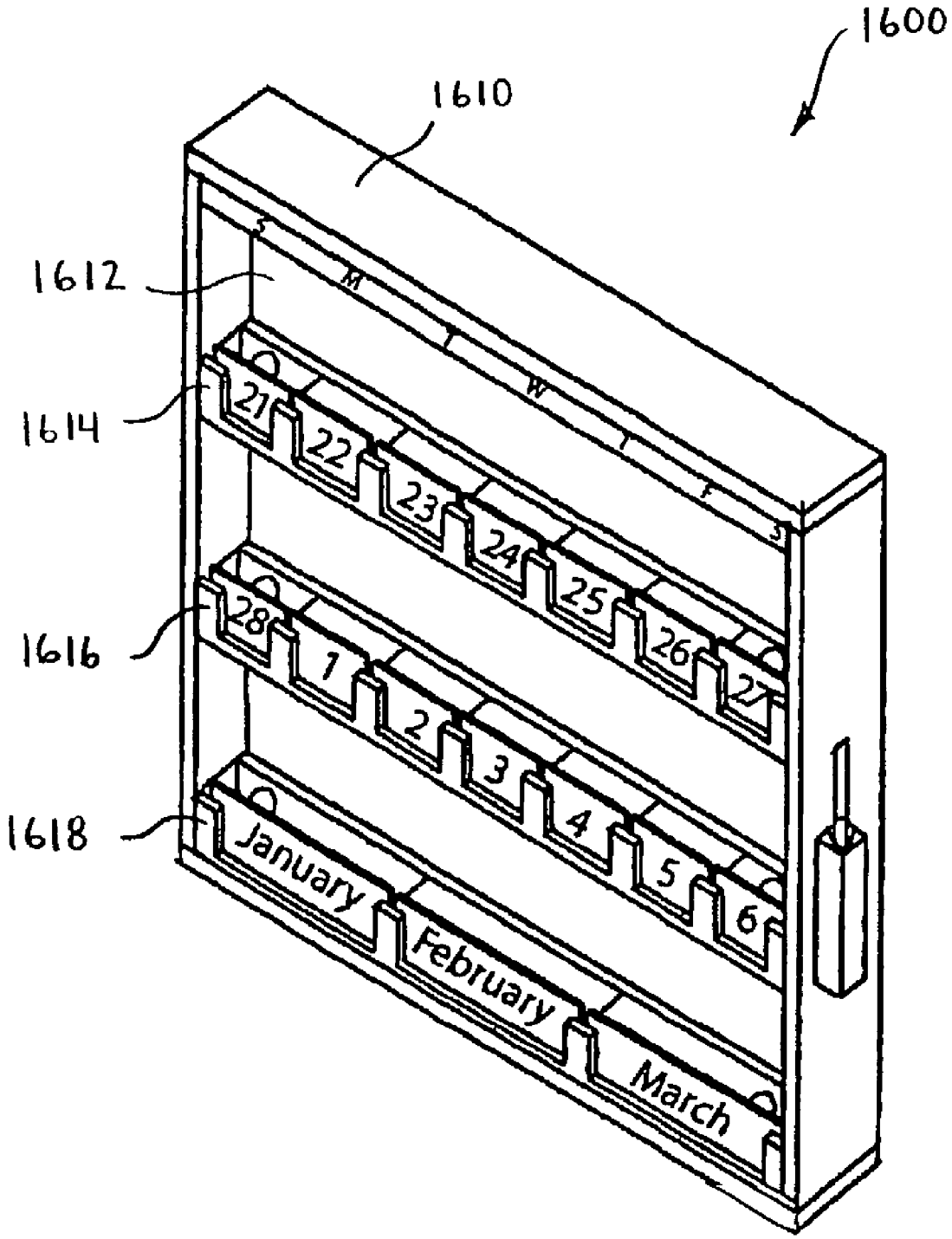
FIG. 39 is a perspective view of an illustrative calendar in accordance with one embodiment of the invention.

It should be appreciated that while the above embodiments of the calendar include six storage tray each having either three, four or seven storage compartments, further embodiments of the calendar may vary the number of storage trays used or storage compartments provided with a given calendar. FIG. 39 is an illustrative calendar in accordance with one embodiment of the invention. As shown in FIG. 39, calendar 1600 is comprised of calendar frame 1610, backing 1612, and storage trays 1614, 1616 and 1618. Thus, in this embodiment, calendar 1600 may be used to represent two weeks of a calendar period rather than a five week period.

Figure 40:
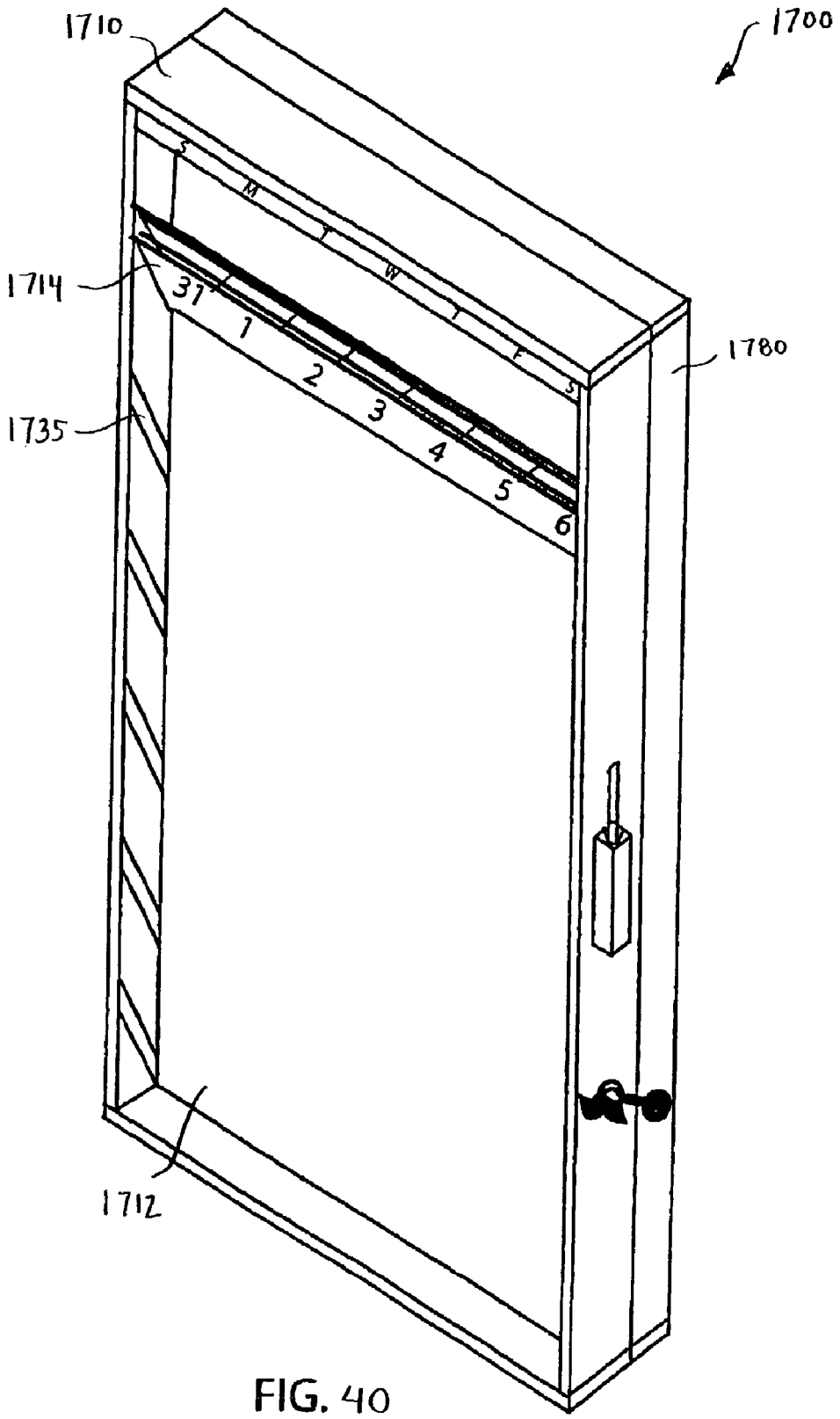
FIG. 40 is a perspective view of an illustrative calendar in accordance with one embodiment of the invention.
Figure 41:
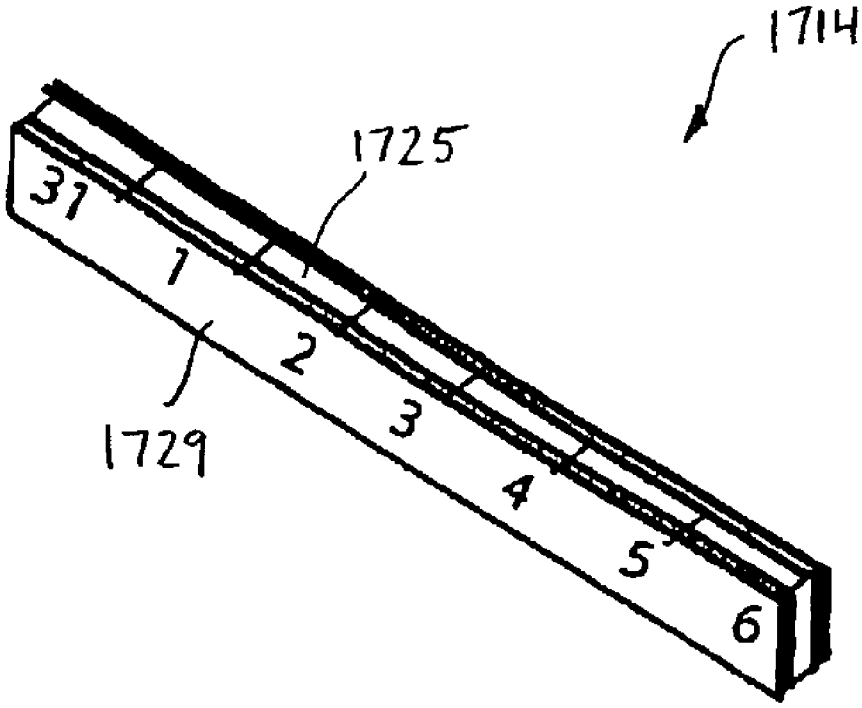
FIG. 41 is a perspective view of the storage tray of FIG. 40 in further detail in accordance with one embodiment of the invention.

In further embodiments of the invention, additional securing mechanisms may be utilized in the calendar frame rather than the backing, for attaching the storage trays to the calendar. FIG. 40 is a perspective view of an illustrative calendar in accordance with another embodiment of the invention. As shown in FIG. 40, calendar 1700 is comprised of calendar frame 1710, backing 1712, and storage cabinet 1780. Securing mechanisms 1735, which in this embodiment are slots formed within calendar frame 1710, are used to attach the storage trays to the calendar 1700, as shown with storage tray 1714. In this embodiment, storage tray 1714 is configured to slide into slots 1735 for securing storage tray 1714 to frame 1710. Accordingly, FIG. 41 is a perspective view of storage tray of FIG. 40 in further detail. Storage tray 1714 includes a plurality of storage compartments 1725 and calendar identifier 1729, which in this embodiment, is comprised of an erasable surface.

With reference to FIGS. 1-41 above, many embodiments of illustrative calendars in accordance with the invention have been described in detail. In general, each of the calendars described above are comprised of a backing, an outer frame, and a plurality of storage trays having a plurality of storage compartments. Several securing mechanisms located on the calendar backing or frame and the storage trays themselves cooperate to secure the storage trays to the calendar backing in a quick-release relationship. The quick-release cooperation of the securing mechanisms located on the calendar backing and the storage trays allows a user to rotate the various storage trays through a series of calendar positions associated with the actual calendar period. In accordance with the invention, various embodiments of the storage trays, securing mechanisms, calendar identifiers and other features of the calendar as described herein may be utilized by the user.

While various embodiments of calendars in accordance with the invention have been described above, it should be appreciated that many of the components of each calendar may be combined in various ways as desired by the skilled artisan. It should be appreciated that in each calendar embodiment, the storage trays may be rotated through different calendar positions on the calendar that allow the user manage a date cycling calendar. Additionally, the storage compartments of the storage trays allow the user to store articles on the calendar associated with a particular date or day in a calendar period.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its preferred embodiment, it is to be understood that this disclosure is only illustrative and exemplary of the present invention and is made merely for the purposes of providing a full and enabling disclosure of the invention. Many modifications to the embodiments described above can be made without departing from the spirit and scope of the invention. Accordingly, the foregoing disclosure is not intended to be construed or to limit the present invention or otherwise to exclude any other such embodiments, adaptations, variations, modifications and equivalent arrangements.

What is claimed is:

1. A calendar comprising:

a backing member;

a plurality of securing mechanisms on said backing member, each of said securing mechanisms being associated with a calendar position provided by the backing member; and a plurality of detachable storage trays each having a plurality of storage compartments and a tray securing mechanism, each of said storage compartments having an associated calendar identifier, said tray securing mechanisms configured for quick-release attachment to and quick-release detachment from each securing mechanism associated with a calendar position.

2. The calendar of claim 1, wherein the backing member has a calendar surface.

3. The calendar of claim 2, wherein the calendar positions are arranged in rows on the calendar surface of the backing member.

4. The calendar of claim 1, wherein the calendar positions are arranged for displaying the associated calendar identifiers of the detachable storage tray in a given calendar position.

5. The calendar of claim 1, wherein each calendar position is arranged for horizontal attachment of the detachable storage trays on the backing member.

6. The calendar of claim 1, wherein at least one securing mechanism comprises a slot formed in the backing member, and at least one tray securing mechanism comprises a flange extending from a rear surface of a first detachable tray for inserting into the slot.

7. The calendar of claim 1, wherein at least one securing mechanism comprises a hook and loop fastener connector piece, and at least one tray securing mechanism comprises a cooperating hook and loop fastener connector piece.

8. The calendar of claim 1, wherein at least one securing mechanism includes at least one magnet, and at least one tray securing mechanism includes at least one magnet cooperating element.

9. The calendar of claim 1, wherein at least one tray securing mechanism includes at least one magnet, and at least one securing mechanism includes at least one magnet cooperating element.

10. The calendar of claim 1, wherein at least one securing mechanism includes at least one mirror hook, and at least one tray securing mechanism includes at least one hole.

11. The calendar of claim 1, wherein at least one securing mechanism includes at least one peg, and at least one tray securing mechanism includes at least one hole.

12. The calendar of claim 1, wherein at least one securing mechanism includes at least one screw, and at least one tray securing mechanism includes at least one hole.

13. The calendar of claim 1, wherein at least one calendar identifier includes indicia of a calendar date.

14. The calendar of claim 1, wherein at least one calendar identifier is comprised of a rewritable surface.

15. The calendar of claim 1, wherein a storage cabinet is hingedly affixed to the calendar.

16. The calendar of claim 1, wherein at least one of the plurality of storage trays has a front surface comprised of a rewritable surface.

17. The calendar of claim 1, wherein the backing member has at least one keyhole to hang the calendar on a wall.

18. The calendar of claim 1, wherein an accessory attachment device is affixed to the calendar.

19. The calendar of claim 18, wherein the accessory attachment device includes at least one hook.

20. A calendar comprising:

a backing member providing a plurality of calendar positions;

a first securing mechanism on the backing member associated with a first calendar position;

a second securing mechanism on the backing member associated with a second calendar position; and a plurality of detachable storage trays, each of said detachable storage trays including a plurality of storage compartments having an associated calendar identifier, and at least one tray securing mechanism;

wherein a first detachable storage tray having a first tray securing mechanism is configured for quick-release attachment to and quick-release detachment from the first calendar position and the second calendar position.

* * * * *